US011766875B2

(12) United States Patent
Mochizuki

(10) Patent No.: US 11,766,875 B2
(45) Date of Patent: Sep. 26, 2023

(54) THREE-DIMENSIONAL OBJECT PRINTING APPARATUS AND THREE-DIMENSIONAL OBJECT PRINTING METHOD

(71) Applicant: SEIKO EPSON CORPORATION, Tokyo (JP)

(72) Inventor: Kenju Mochizuki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 17/448,925

(22) Filed: Sep. 27, 2021

(65) Prior Publication Data

US 2022/0097410 A1 Mar. 31, 2022

(30) Foreign Application Priority Data

Sep. 29, 2020 (JP) ..... 2020-163747

(51) Int. Cl.
*B41J 3/407* (2006.01)
*B41J 2/045* (2006.01)

(52) U.S. Cl.
CPC ..... *B41J 3/4073* (2013.01); *B41J 2/04556* (2013.01); *B41J 2/04586* (2013.01)

(58) Field of Classification Search
CPC ..... B41J 3/4073
See application file for complete search history.

(56) References Cited

U.S. PATENT DOCUMENTS

2014/0063096 A1 3/2014 Pitz et al.
2019/0134993 A1* 5/2019 Leo ..... H04N 1/0019
2020/0101605 A1 4/2020 Miyamoto et al.

FOREIGN PATENT DOCUMENTS

CN 110341323 A * 10/2019 ..... B41J 29/393
JP 2014-050832 A 3/2014
JP 2020-049641 A 4/2020
JP 2022027453 * 2/2022
WO WO-2022023851 A1 * 2/2022

OTHER PUBLICATIONS

Xie, MachineTranslationofCN-110341323-A, 2019 (Year: 2019).*
Kitaoka, MachineTranslationofJP2022027453, 2022.*

* cited by examiner

*Primary Examiner* — Scott A Richmond
(74) *Attorney, Agent, or Firm* — WORKMAN NYDEGGER

(57) ABSTRACT

A three-dimensional object printing apparatus includes a liquid discharge head having a nozzle surface provided with a nozzle array including a plurality of nozzles for discharging a liquid, a moving mechanism that changes a position of the liquid discharge head with respect to a three-dimensional workpiece, and a sensor that detects a positional relationship of the liquid discharge head with respect to the workpiece, in which when an axis parallel to a normal line of the nozzle surface is set as a first axis, an axis parallel to the nozzle surface and intersecting an extending direction of the nozzle array is set as a second axis, and an axis that intersects both the first axis and the second axis is set as a third axis, the sensor detects a relative positional relationship of the liquid discharge head with respect to the workpiece in a direction along the third axis.

17 Claims, 13 Drawing Sheets

THREE-DIMENSIONAL OBJECT PRINTING APPARATUS AND THREE-DIMENSIONAL OBJECT PRINTING METHOD

The present application is based on, and claims priority from JP Application Serial Number 2020-163747, filed Sep. 29, 2020, the disclosure of which is hereby incorporated by reference herein in its entirety.

BACKGROUND

1. Technical Field

The present disclosure relates to a three-dimensional object printing apparatus and a three-dimensional object printing method.

2. Related Art

A three-dimensional object printing apparatus that performs printing on a surface of a three-dimensional object by an ink jet method has been known. For example, the device described in JP-A-2014-50832 includes a robot arm and a print head fixed to an end portion of the robot arm. JP-A-2014-50832 describes a curved surface of a vehicle as an object to be printed.

When the print head is linearly moved along a scanning path by a combination of operations of the plurality of movable portions, the following problems may occur. Even if the controller is simply given an ideal path as an instruction of the path along which the print head should move, since the operation error of each joint portion appears at various timings in the middle of the scanning path, there is a problem that an actual path meanders and deviates from the ideal path, resulting in deterioration of printing image quality.

SUMMARY

According to an aspect of the present disclosure, there is provided a three-dimensional object printing apparatus including a liquid discharge head having a nozzle surface provided with a nozzle array including a plurality of nozzles for discharging a liquid, a moving mechanism that changes a position of the liquid discharge head with respect to a three-dimensional workpiece, and a sensor that detects a positional relationship of the liquid discharge head with respect to the workpiece, in which when an axis parallel to a normal line of the nozzle surface is set as a first axis, an axis parallel to the nozzle surface and intersecting an extending direction of the nozzle array is set as a second axis, and an axis that intersects both the first axis and the second axis is set as a third axis, the sensor detects a relative positional relationship of the liquid discharge head with respect to the workpiece in a direction along the third axis.

According to another aspect of the present disclosure, there is provided a three-dimensional object printing apparatus including a liquid discharge head having a nozzle surface provided with a nozzle array including a plurality of nozzles for discharging a liquid, a moving mechanism that changes a position of the liquid discharge head with respect to a three-dimensional workpiece, and a sensor that detects a positional relationship of the liquid discharge head with respect to the workpiece, in which when an axis parallel to a liquid discharge direction from the liquid discharge head is set as a first axis, an axis parallel to a scanning direction of the liquid discharge head with respect to the workpiece by the moving mechanism is set as a second axis, and an axis that intersects both the first axis and the second axis is set as a third axis, the sensor detects a relative positional relationship of the liquid discharge head with respect to the workpiece in a direction along the third axis.

According to still another aspect of the present disclosure, there is provided a three-dimensional object printing method for printing on a three-dimensional workpiece by using a liquid discharge head having a nozzle surface provided with a nozzle array including a plurality of nozzles for discharging a liquid, and a moving mechanism that changes a position of the liquid discharge head with respect to the workpiece. When an axis parallel to a liquid discharge direction from the liquid discharge head is set as a first axis, an axis parallel to a scanning direction of the liquid discharge head with respect to the workpiece by the moving mechanism is set as a second axis, and an axis that intersects both the first axis and the second axis is set as a third axis, a detection operation of detecting a relative positional relationship of the liquid discharge head with respect to the workpiece in a direction along the third axis is executed.

DESCRIPTION OF EXEMPLARY EMBODIMENTS

Figure 1:
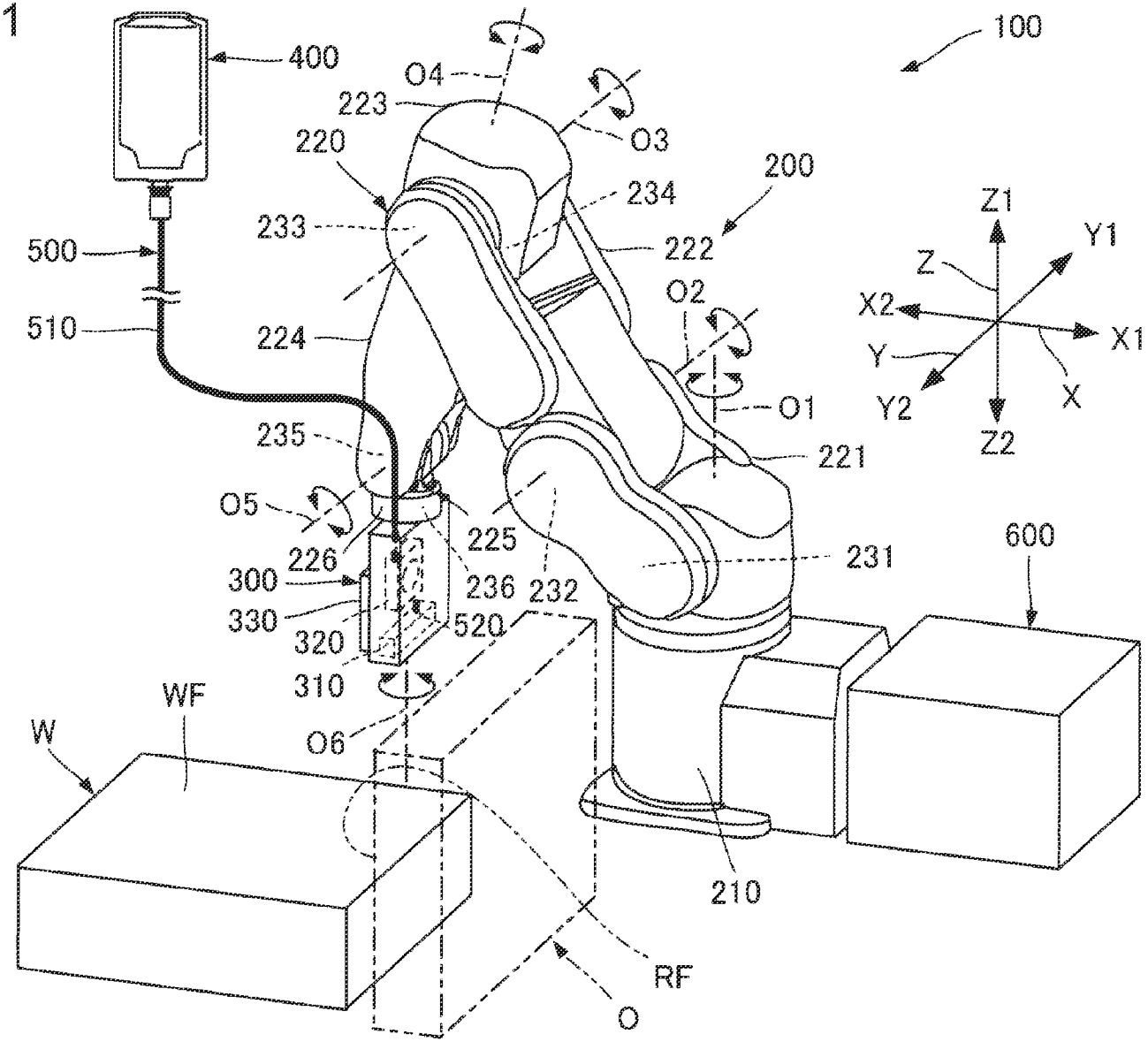
FIG. 1 is a perspective view illustrating an outline of a three-dimensional object printing apparatus according to a first embodiment.

Hereinafter, preferred embodiments according to the present disclosure will be described with reference to the accompanying drawings. In the drawings, the dimensions or scales of each portion are appropriately different from the actual dimensions or scales, and some portions are schematically illustrated for easy understanding. The scope of the present disclosure is not limited to these embodiments unless otherwise particularly stated to limit the present disclosure in the following description.

The following description will be performed by using an X-axis, a Y-axis, and a Z-axis that intersect each other as appropriate. One direction along the X-axis is referred to as an X1 direction, and a direction opposite to the X1 direction is referred to as an X2 direction. Similarly, directions opposite to each other along the Y-axis are referred to as a Y1 direction and a Y2 direction. Directions opposite to each other along the Z-axis are referred to as a Z1 direction and a Z2 direction.

Here, the X-axis, the Y-axis, and the Z-axis are coordinate axes of a base coordinate system set in a space in which a workpiece W and a base 210 to be described later are installed. Typically, the Z-axis is a vertical axis, and the Z2 direction corresponds to a downward direction in a vertical direction. The Z-axis may not be a vertical axis. Although the X-axis, the Y-axis, and the Z-axis are typically orthogonal to each other, the present disclosure is not limited thereto, and the axes may not be orthogonal to each other. For example, the X-axis, Y-axis, and Z-axis may intersect each other at an angle within a range of 80° or more and 100° or less.

1. First Embodiment

1-1. Outline of Three-Dimensional Object Printing Apparatus

FIG. 1 is a perspective view illustrating an outline of a three-dimensional object printing apparatus 100 according to a first embodiment. The three-dimensional object printing apparatus 100 is an apparatus that prints on the surface of the three-dimensional workpiece W by an ink jet method.

The workpiece W has a surface WF as a printing target. In the example illustrated in FIG. 1, the workpiece W is a rectangular parallelepiped, and the surface WF is a plane facing the Z1 direction. The printing target may be a surface other than the surface WF among the plurality of surfaces of the workpiece W. The size, shape, or installation pose of the workpiece W is not limited to the example illustrated in FIG. 1, and is any size, shape, or installation pose.

In the example illustrated in FIG. 1, the three-dimensional object printing apparatus 100 is an ink jet printer using a vertical articulated robot. Specifically, as illustrated in FIG. 1, the three-dimensional object printing apparatus 100 includes a robot 200, a liquid discharge head unit 300, a liquid reservoir 400, a supply flow path 500, and a control device 600 which is an example of a "controller". Hereinafter, first, each portion of the three-dimensional object printing apparatus 100 will be briefly described in sequence.

The robot 200 is an example of a moving mechanism that changes a position and a pose of the liquid discharge head unit 300 with respect to the workpiece W. In the example illustrated in FIG. 1, the robot 200 is a so-called 6-axis vertical articulated robot. Specifically, the robot 200 has a base 210 and an arm 220.

The base 210 is a base that supports the arm 220. In the example illustrated in FIG. 1, the base 210 is fixed to an installation surface such as a floor surface facing the Z1 direction by screwing or the like. The installation surface to which the base 210 is fixed may be a surface facing any direction, but is not limited to the example illustrated in FIG. 1, and may be, for example, a surface of a wall, a ceiling, a movable carriage, or the like.

The arm 220 is a 6-axis robot arm having a base end attached to the base 210 and a tip of which a position and a pose is three-dimensionally changed with respect to the base end. Specifically, the arm 220 has arms 221, 222, 223, 224, 225, and 226, and these arms are coupled in this order.

The arm 221 is rotatably coupled to the base 210 around a first rotation axis O1 via a joint portion 231. The arm 222 is rotatably coupled to the arm 221 around a second rotation axis O2 via a joint portion 232. The arm 223 is rotatably coupled to the arm 222 around a third rotation axis O3 via a joint portion 233. The arm 224 is rotatably coupled to the arm 223 around a fourth rotation axis O4 via a joint portion 234. The arm 225 is rotatably coupled to the arm 224 around a fifth rotation axis O5 via a joint portion 235. The arm 226 is rotatably coupled to the arm 225 around a sixth rotation axis O6 via a joint portion 236.

In the example illustrated in FIG. 1, each of the joint portions 231 to 236 is a mechanism for rotatably coupling one of two adjacent arms to the other arm. Although not illustrated, a drive mechanism for rotating one of two adjacent arms with respect to the other arm is provided in each of the joint portions 231 to 236. The drive mechanism includes, for example, a motor that generates a driving force for the rotation, a speed reducer that decelerates and outputs the driving force, and an encoder such as a rotary encoder that detects an angle of the rotation or the like. The drive mechanism corresponds to an arm drive mechanism 230 illustrated in FIG. 2 to be described later.

The first rotation axis O1 is an axis perpendicular to an installation surface (not illustrated) to which the base 210 is fixed. The second rotation axis O2 is an axis perpendicular to the first rotation axis O1. The third rotation axis O3 is an axis parallel to the second rotation axis O2. The fourth rotation axis O4 is an axis perpendicular to the third rotation axis O3. The fifth rotation axis O5 is an axis perpendicular to the fourth rotation axis O4. The sixth rotation axis O6 is an axis perpendicular to the fifth rotation axis O5.

As for these rotation axes, a case where one axis is "perpendicular" to the other axis includes a case where the angle formed by the two rotation axes is strictly 90° and a case where the angle formed by the two rotation axes deviates within a range of about 90° to ±5°. Similarly, a case where one axis is "parallel" to the other axis includes a case where the two rotation axes are strictly parallel and a case where one of the two rotation axes tilts with respect to the other axis within a range of about ±5°.

The liquid discharge head unit 300 is attached, as an end effector, to a tip of the arm 221, that is, the arm 226.

The liquid discharge head unit 300 is a mechanism having a liquid discharge head 310 that discharges ink which is an example of a liquid toward the workpiece W. In the present embodiment, the liquid discharge head unit 300 includes a pressure adjustment valve 320 that adjusts the pressure of the ink supplied to the liquid discharge head 310 and a sensor 330 that detects the relative positional relationship of the liquid discharge head 310 with respect to the workpiece W, in addition to the liquid discharge head 310. Since both the pressure adjustment valve and the imaging device are fixed to the arm 226, a relationship between the positions and the poses is fixed.

The liquid discharge head 310 will be described in detail later. The pressure adjustment valve 320 is a valve mechanism that opens and closes according to the pressure of the ink in the liquid discharge head 310. By this opening and closing, the pressure of the ink in the liquid discharge head 310 is maintained at a negative pressure within a predetermined range. Thus, a meniscus of the ink formed in the nozzle N of the liquid discharge head 310 is stabilized. As a result, it is possible to prevent air bubbles from entering the nozzle N and the ink from overflowing from the nozzle N.

The number of each of the liquid discharge head 310 and the pressure adjustment valve 320 included in the liquid discharge head unit 300 is one in the example illustrated in FIG. 1, but the number is not limited to the example illustrated in FIG. 1, and may be two or more. The installation position of the pressure adjustment valve 320 and the sensor 330 is not limited to the arm 226, and may be, for example, another arm or the like, or may be a fixed position with respect to the base 210.

The sensor 330 detects the relative positional relationship of the liquid discharge head 310 with respect to the workpiece W in a direction intersecting both the ink discharge direction from the liquid discharge head 310 and the scanning direction of the liquid discharge head 310. Specifically, the sensor 330 is a distance sensor such as an optical displacement meter that measures the distance from a reference plane RF of which a position is fixed relative to the workpiece W. The reference plane RF is the surface of an object O illustrated by a dashed double-dotted line in FIG. 1.

A shape of the object O is not limited to the example illustrated in FIG. 1, and is any shape. In the example illustrated in FIG. 1, the object O is separate from the workpiece W, but the object O may be integrated with the workpiece W. That is, the reference plane RF may be the surface of any object as long as the position relative to the workpiece W is fixed, may be the surface of the workpiece W, or may be the surface of an object separate from the workpiece W. The direction in which the reference plane RF faces is not limited to the example illustrated in FIG. 1 and is any direction as long as the position and pose of the workpiece W with respect to the surface WF are known in advance.

The liquid reservoir 400 is a container that reserves the ink. The liquid reservoir 400 is, for example, a bag-shaped ink pack made of a flexible film. The ink reserved in the liquid reservoir 400 is, for example, ink containing a coloring material such as a dye or a pigment. A type of the ink reserved in the liquid reservoir 400 is not limited to the ink containing the coloring material, and may be, for example, ink containing a conductive material such as metal powder. The ink may have curability such as ultraviolet curability. When the ink has the curability such as ultraviolet curability, for example, an ultraviolet irradiation mechanism is mounted on the liquid discharge head unit 300.

In the example illustrated in FIG. 1, the liquid reservoir 400 is fixed to a wall, a ceiling, a pillar, or the like such that the liquid reservoir is constantly positioned in the Z1 direction from the liquid discharge head 310. That is, the liquid reservoir 400 is positioned above a moving region of the liquid discharge head 310 in the vertical direction. Thus, the ink can be supplied from the liquid reservoir 400 to the liquid discharge head 310 with a predetermined pressing force without using a mechanism such as a pump.

The liquid reservoir 400 can be installed at a position such that the ink is supplied from the liquid reservoir 400 to the liquid discharge head 310 with a predetermined pressure, and the liquid reservoir may be positioned below the liquid discharge head 310 in the vertical direction. In this case, for example, the ink may be supplied from the liquid reservoir 400 to the liquid discharge head 310 at a predetermined pressure by using a pump.

The supply flow path 500 is a flow path for supplying the ink from the liquid reservoir 400 to the liquid discharge head 310. The pressure adjustment valve 320 is provided in the middle of the supply flow path 500. Thus, even though a positional relationship between the liquid discharge head 310 and the liquid reservoir 400 changes, a fluctuation in a pressure of the ink in the liquid discharge head 310 can be reduced.

The supply flow path 500 is divided into an upstream flow path 510 and a downstream flow path 520 by the pressure adjustment valve 320. That is, the supply flow path 500 has the upstream flow path 510 that communicatively couples the liquid reservoir 400 and the pressure adjustment valve 320, and the downstream flow path 520 that communicatively couples the pressure adjustment valve 320 and the liquid discharge head 310.

Each of the upstream flow path 510 and the downstream flow path 520 is formed by, for example, an internal space of a pipe body. Here, the pipe body used for the upstream flow path 510 is made of, for example, an elastic material such as a rubber material or an elastomer material, and has flexibility. As stated above, the upstream flow path 510 is formed by using the flexible pipe body, and thus, a change in the relative positional relationship between the liquid reservoir 400 and the pressure adjustment valve 320 is allowed. Accordingly, even though the position or the pose of the liquid discharge head 310 changes while the position and the pose of the liquid reservoir 400 are fixed, the ink can be supplied from the liquid reservoir 400 to the pressure adjustment valve 320. On the other hand, the pipe body used for the downstream flow path 520 may not have flexibility. Accordingly, the pipe body used for the downstream flow path 520 may be made of an elastic material such as a rubber material or an elastomer material, or may be made of a hard material such as a resin material.

A part of the upstream flow path 510 may be formed by a member having no flexibility. The downstream flow path 520 is not limited to the configuration using the pipe body. For example, a part or the entirety of the downstream flow path 520 may have a distribution flow path for distributing the ink from the pressure adjustment valve 320 to a plurality of locations, or may be integrally formed with the liquid discharge head 310 or the pressure adjustment valve 320.

The control device 600 is a device that controls the driving of each portion of the three-dimensional object printing apparatus 100. Here, the control device 600 is a robot controller that controls the driving of the liquid discharge head 310 and the robot 200. The control device 600 will be described in detail together with the following description of an electrical configuration of the three-dimensional object printing apparatus 100.

1-2. Electrical Configuration of Three-Dimensional Object Printing Apparatus

Figure 2:
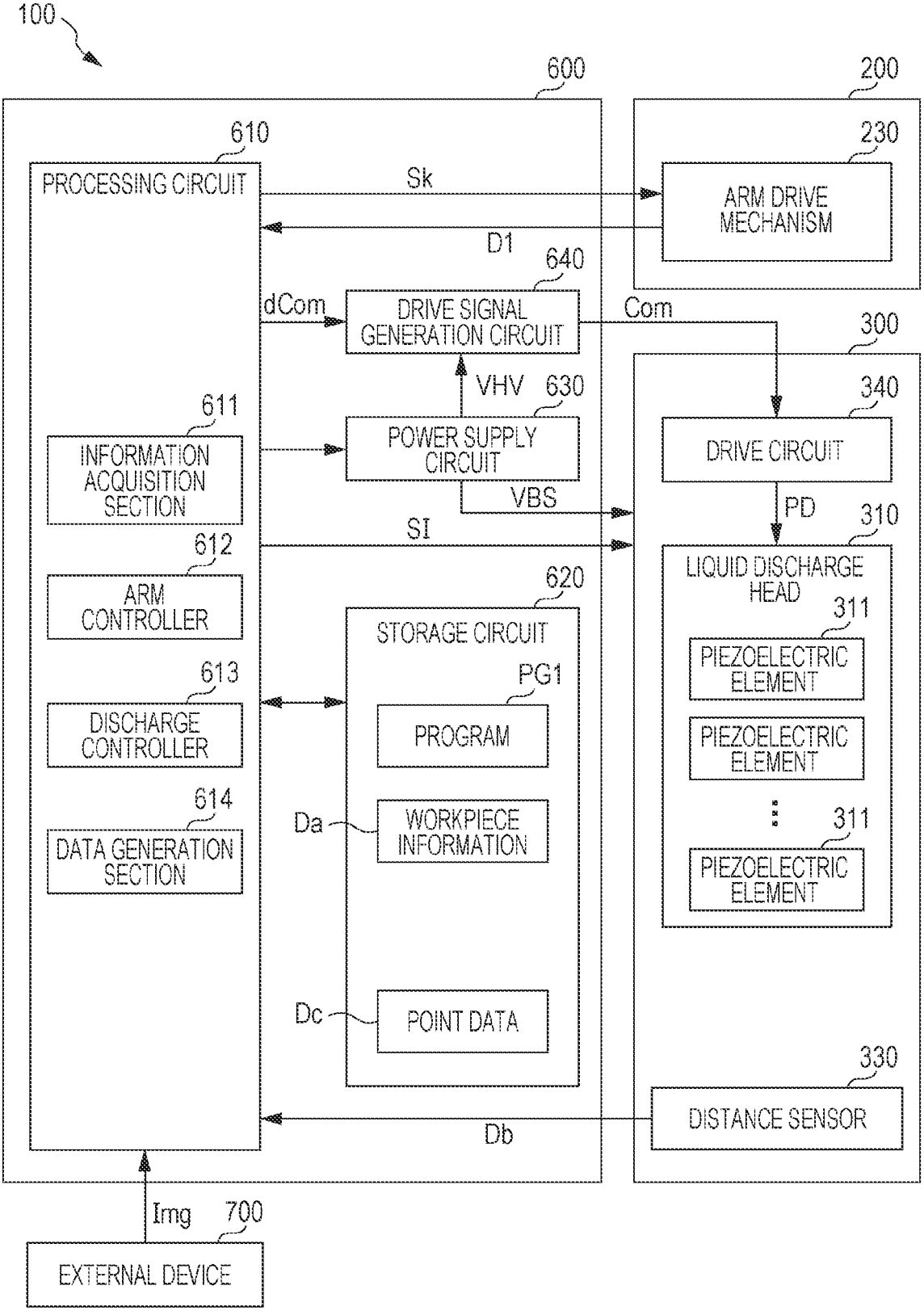
FIG. 2 is a block diagram illustrating an electrical configuration of the three-dimensional object printing apparatus according to the first embodiment.

FIG. 2 is a block diagram illustrating an electrical configuration of the three-dimensional object printing apparatus 100 according to the first embodiment. FIG. 2 illustrates electrical components among the components of the three-dimensional object printing apparatus 100. As illustrated in FIG. 2, the control device 600 includes a processing circuit 610, a storage circuit 620, a power supply circuit 630, and a drive signal generation circuit 640.

A hardware configuration included in the control device 600 to be described below may be appropriately divided. For example, an arm controller 612 and the drive signal generation circuit 640 of the control device 600 may be provided separately in different hardware configurations. A part or all of the functions of the control device 600 may be realized by an external device 700 coupled to the control device 600, or may be realized by another external device such as a personal computer (PC) coupled to the control device 600 via a network such as a local area network (LAN) or the Internet.

The processing circuit 610 has a function of controlling an operation of each portion of the three-dimensional object printing apparatus 100 and a function of processing various data. The processing circuit 610 includes, for example, one or more processors such as a central processing unit (CPU). The processing circuit 610 may include a programmable logic device such as a field-programmable gate array (FPGA) instead of the CPU or in addition to the CPU.

The storage circuit 620 stores various programs such as a program PG1 executed by the processing circuit 610 and various data such as workpiece information Da, and point data Dc processed by the processing circuit 610. The storage circuit 620 includes, for example, one or both semiconductor memories of a volatile memory such as a random access memory (RAM) and a non-volatile memory such as a read only memory (ROM), an electrically erasable programmable read-only memory (EEPROM) or a programmable ROM (PROM). The storage circuit 620 may be formed as a part of the processing circuit 610.

The workpiece information Da is information indicating the position and shape of the surface WF of the workpiece W. The workpiece information Da is, for example, information in which information such as computer-aided design (CAD) data indicating the three-dimensional shape of the workpiece W is associated with the above-mentioned base coordinate system. The workpiece information Da is generated by a data generation section 614 described later. The information indicating the three-dimensional shape of the workpiece W is included in print data Img, or is input to the control device 600 from the external device 700 separately from the print data Img.

The point data Dc is information indicating a position where the liquid discharge head 310 should pass. The point data Dc indicates, for example, the scanning path of the liquid discharge head 310 with respect to the workpiece W with the coordinate values of the base coordinate system. The point data Dc is generated by the data generation section 614 described later.

The power supply circuit 630 receives a power from a commercial power supply (not illustrated) and generates various predetermined potentials. The generated various potentials are appropriately supplied to each portion of the three-dimensional object printing apparatus 100. For example, the power supply circuit 630 generates a power supply potential VHV and an offset potential VBS. The offset potential VBS is supplied to the liquid discharge head unit 300. The power supply potential VHV is supplied to the drive signal generation circuit 640.

The drive signal generation circuit 640 is a circuit that generates a drive signal Com for driving each piezoelectric element 311 included in the liquid discharge head 310. Specifically, the drive signal generation circuit 640 has, for example, a DA conversion circuit and an amplifier circuit. In the drive signal generation circuit 640, the DA conversion circuit converts a waveform designation signal dCom to be described later from the processing circuit 610 from a digital signal to an analog signal, and the amplifier circuit amplifies the analog signal by using the power supply potential VHV from the power supply circuit 630 and generates the drive signal Com. Here, among waveforms included in the drive signal Com, a signal of the waveform actually supplied to the piezoelectric element 311 is a drive pulse PD. The drive pulse PD is supplied from the drive signal generation circuit 640 to the piezoelectric element 311 via the drive circuit 340 for driving the piezoelectric element 311. The drive circuit 340 switches whether to supply, as the drive pulse PD, at least a part of the waveforms included in the drive signal Com based on a control signal SI to be described later.

In the above control device 600, the processing circuit 610 controls an operation of each portion of the three-dimensional object printing apparatus 100 by executing the program PG1 stored in the storage circuit 620. Specifically, the processing circuit 610 functions as an information acquisition section 611, the arm controller 612, a discharge controller 613, and the data generation section 614 by executing the program PG1.

The information acquisition section 611 acquires various information necessary for driving the robot 200 and the liquid discharge head unit 300. Specifically, the information acquisition section 611 acquires information including the print data Img from the external device 700, information D1 from the encoder included in the arm drive mechanism 230, detection data Db from the sensor 330, the workpiece information Da, and the point data Dc from the storage circuit 620. The information acquisition section 611 appropriately stores various acquired information in the storage circuit 620. The detection data Db is information indicated by an output signal from the sensor 330, and is information regarding the relative positional relationship of the liquid discharge head 310 with respect to the workpiece W.

The arm controller 612 controls the driving of the robot 200 based on the information from the information acquisition section 611. Specifically, the arm controller 612 generates a control signal Sk based on the information D1, the workpiece information Da, the detection data Db, and the point data Dc. The control signal Sk controls the driving of the motor included in the arm drive mechanism 230 such that the liquid discharge head 310 is in a desired position and a desired pose.

A correspondence between the information D1 and the position and the pose of the liquid discharge head is acquired in advance by calibration or the like, and is stored in the storage circuit 620. The arm controller 612 acquires information on the actual position and pose of the liquid discharge head 310 based on the information D1 from the actual arm drive mechanism 230 and the correspondence. Then, the arm controller 612 controls the liquid discharge head 310 to be in a desired position and pose by using the information on the position and the pose.

Here, the arm controller 612 controls the position of the liquid discharge head 310 based on the detection data Db and the point data Dc. In the present embodiment, the positions of the liquid discharge head 310 with respect to the X coordinate, the Y coordinate, and the Z coordinate are controlled by using the point data Dc during the execution of the printing operation MP described later for printing the image based on the print data Img. Here, with respect to the X coordinate, the position is controlled by using the detection data Db in addition to the point data Dc.

The image based on the print data Img is printed by the printing operation MP N (N is a natural number of 1 or more) indicating the number of passes. In the following, the printing operation MP of an Nth pass is referred to as "printing operation MP_N". Here, the printing operation MP of a first pass is a first printing operation MP_1. The printing operation MP of a second pass is a second printing operation MP_2.

The discharge controller 613 controls the driving of the liquid discharge head unit 300 based on the information from the information acquisition section 611. Specifically, the discharge controller 613 generates the control signal SI and the waveform designation signal dCom based on the print data Img. The control signal SI is a digital signal for designating an operating state of the piezoelectric element 311 to be described later which is included in the liquid discharge head 310. Here, the control signal SI may include other signals such as a timing signal for defining a drive timing of the piezoelectric element 311. The timing signal is generated, for example, based on the information D1 from the encoder included in the arm drive mechanism 230. The waveform designation signal dCom is a digital signal for defining a waveform of the drive signal Com. The print data Img is information indicating a two-dimensional or three-dimensional image, and is supplied from the external device 700 such as a personal computer.

The drive control of the liquid discharge head 310 by the discharge controller 613 as described above is performed in the printing operation MP in synchronization with the drive control of the robot 200 by the arm controller 612 described above. Here, while the robot 200 causes the liquid discharge head 310 to scan the surface WF in a predetermined direction, the liquid discharge head 310 discharges ink so that an image in ink is printed on the surface WF of the workpiece W.

The data generation section 614 generates the point data Dc. As will be described in detail later, the data generation section 614 generates the workpiece information Da, and generates the point data Dc indicating an ideal scanning path based on the workpiece information Da. The ideal scanning path corresponds to, for example, a reference path RU described later. Here, in the generation of the workpiece information Da, as described above, the workpiece W is recognized by using a sensor or a camera (not illustrated) calibrated in the above-mentioned base coordinate system, and the information indicating the three-dimensional shape of the workpiece W is associated with the above-mentioned base coordinate system.

1-3. Liquid Discharge Head Unit

Figure 3:
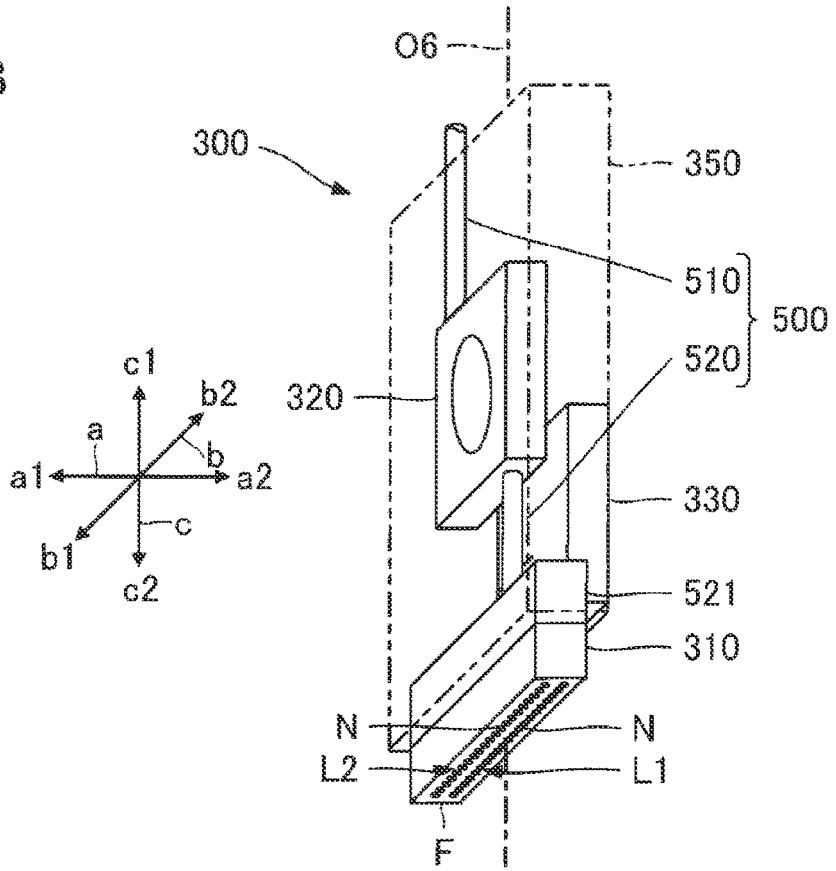
FIG. 3 is a perspective view illustrating a schematic configuration of a liquid discharge head unit according to the first embodiment.

FIG. 3 is a perspective view illustrating a schematic configuration of the liquid discharge head unit 300 according to the embodiment.

The following description will be performed by using an a-axis, a b-axis, and a c-axis that intersect each other as appropriate. The a-axis is an example of a "second axis". The b-axis is an example of a "third axis". The c-axis is an example of a "first axis". One direction along the a-axis is referred to as an a1 direction, and a direction opposite to the a1 direction is referred to as an a2 direction. Similarly, directions opposite to each other along the b-axis are referred to as a b1 direction and a b2 direction. Directions opposite to each other along the c-axis are referred to as a c1 direction and a c2 direction.

Here, the a-axis, the b-axis, and the c-axis are coordinate axes of a tool coordinate system set in the liquid discharge head unit 300, and a relationship between a position and a pose relative to the above-mentioned X-axis, Y-axis, and Z-axis changes by the operation of the above-mentioned robot 200. In the example illustrated in FIG. 3, the c-axis is an axis parallel to the above-mentioned sixth rotation axis O6. Although the a-axis, the b-axis, and the c-axis are typically orthogonal to each other, the present disclosure is not limited thereto, and the axes may intersect at an angle within, for example, a range of 80° or more and 100° or less.

As described above, the liquid discharge head unit 300 has the liquid discharge head 310, the pressure adjustment valve 320, and the sensor 330. These portions are supported by a support 350 illustrated by a dashed double-dotted line in FIG. 3.

The support 350 is made of, for example, a metal material or the like, and is a substantially rigid body. In FIG. 3, the support 350 has a flat box shape, but a shape of the support 350 is not particularly limited and is any shape.

The above support 350 is attached to the tip of the arm 220, that is, the arm 226. Thus, each of the liquid discharge head 310, the pressure adjustment valve 320, and the sensor 330 is fixed to the arm 226.

In the example illustrated in FIG. 3, the pressure adjustment valve 320 is positioned in the c1 direction with respect to the liquid discharge head 310. The sensor 330 is positioned in the a2 direction with respect to the liquid discharge head 310.

In the example illustrated in FIG. 3, a part of the downstream flow path 520 of the supply flow path 500 is formed by the flow path member 521. The flow path member 521 has a flow path for distributing the ink from the pressure adjustment valve 320 to a plurality of locations of the liquid discharge head 310. The flow path member 521 is, for example, a stacked body of a plurality of substrates made of a resin material, and a groove or a hole for a flow path of the ink is appropriately provided in each substrate.

The liquid discharge head 310 has a nozzle surface F and a plurality of nozzles N opened to the nozzle surface F. In the example illustrated in FIG. 3, a normal direction of the nozzle surface F is the c2 direction, and the plurality of nozzles N are divided into a first nozzle array L1 and a second nozzle array L2 arranged at intervals in a direction along the a-axis. Each of the first nozzle array L1 and the second nozzle array L2 is an example of a "nozzle array", and is a set of the plurality of nozzles N linearly arrayed in a direction along the b-axis. Here, in the liquid discharge head 310, elements related to each nozzle N of the first nozzle array L1 and elements related to each nozzle N of the second nozzle array L2 are substantially symmetrical with each other in a direction along the a-axis.

However, positions of the plurality of nozzles N in the first nozzle array L1 and the plurality of nozzles N in the second nozzle array L2 in the direction along the b-axis may or may not coincide with each other. The elements related to each nozzle N of one of the first nozzle array L1 and the second nozzle array L2 may be omitted. Hereinafter, a configuration in which the positions of the plurality of nozzles N in the first nozzle array L1 and the plurality of nozzles N in the second nozzle array L2 in the direction along the b-axis coincide with each other is exemplified.

Figure 4:
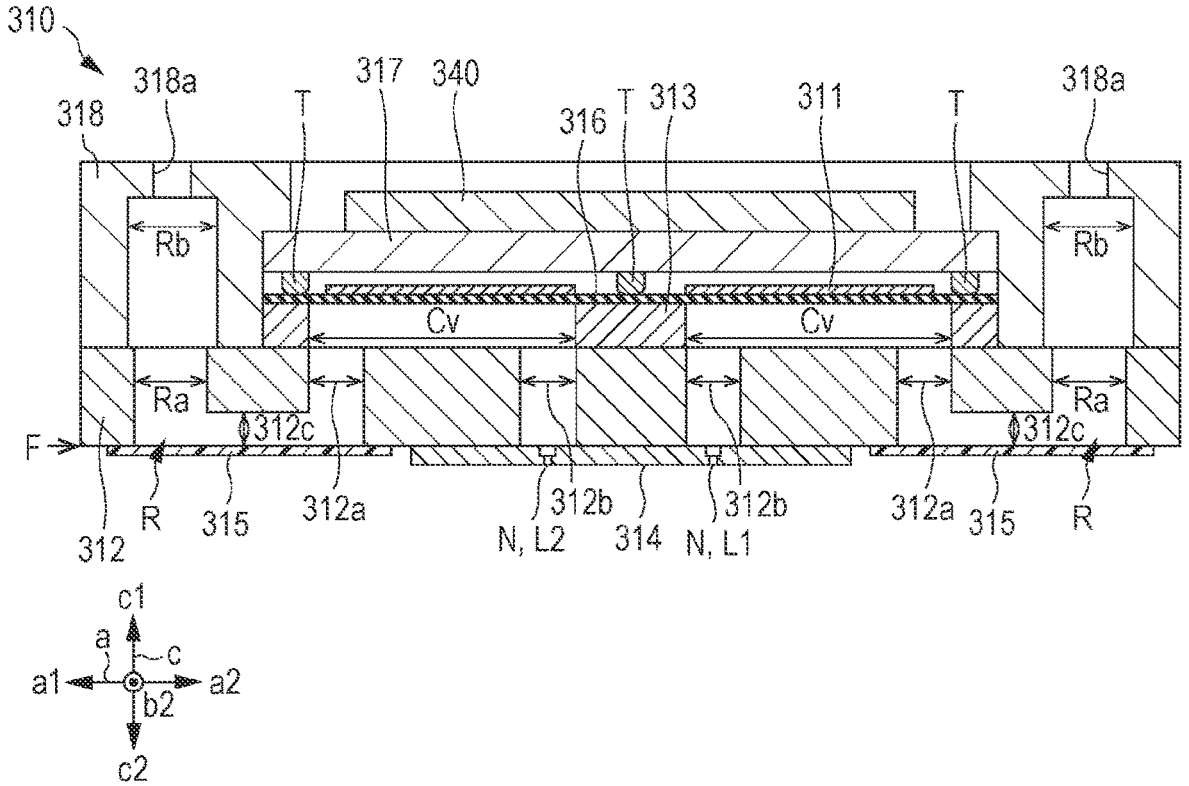
FIG. 4 is a sectional view illustrating a configuration example of the liquid discharge head.

FIG. 4 is a sectional view illustrating a configuration example of the liquid discharge head 310. As illustrated in FIG. 4, the liquid discharge head 310 includes a flow path substrate 312, a pressure chamber substrate 313, a nozzle plate 314, a vibration absorber 315, a vibration plate 316, a plurality of piezoelectric elements 311, a wiring substrate 317, and a housing 318.

The flow path substrate 312 and the pressure chamber substrate 313 form a flow path for supplying the ink to the plurality of nozzles N. The flow path substrate 312 and the pressure chamber substrate 313 are stacked in this order in the c1 direction. Each of the flow path substrate 312 and the pressure chamber substrate 313 is a plate-shaped member elongated in the direction along the b-axis. The flow path substrate 312 and the pressure chamber substrate 313 are joined to each other by, for example, an adhesive.

The vibration plate 316, the wiring substrate 317, the housing 318, and the drive circuit 340 are installed in a region positioned in the c1 direction with respect to the pressure chamber substrate 313. On the other hand, the nozzle plate 314 and the vibration absorber 315 are installed in a region positioned in the c2 direction with respect to the flow path substrate 312. These elements are generally plate-shaped members elongated in the direction along the b-axis like the flow path substrate 312 and the pressure chamber substrate 313, and are joined to each other by, for example, an adhesive.

The nozzle plate 314 is a plate-shaped member in which the plurality of nozzles N are formed. Each of the plurality of nozzles N is a circular through-hole through which the ink passes. For example, the nozzle plate 314 is manufactured by processing a silicon single crystal substrate by a semiconductor manufacturing technology using a processing technology such as dry etching or wet etching. However, other known methods and materials may be appropriately used for manufacturing the nozzle plate 314.

Here, the above-described nozzle surface F is a surface that expands from an opening of one end of the nozzle N in the c2 direction along a direction perpendicular to the c-axis among surfaces constituting an outer shape of the liquid discharge head 310. In the example illustrated in FIG. 4, a surface of the liquid discharge head 310 facing the c2 direction is the nozzle surface F, and the nozzle surface F includes a surface of the nozzle plate 314 facing the c2 direction.

A space Ra, a plurality of supply flow paths 312*a*, a plurality of communication flow paths 312*b*, and a supply liquid chamber 312*c* are provided in the flow path substrate 312 for each of the first nozzle array L1 and the second nozzle array L2. The space Ra is a long opening extending in the direction along the b-axis in plan view in a direction along the c-axis. Each of the supply flow paths 312*a* and the communication flow paths 312*b* is a through-hole formed for each nozzle N. The supply liquid chamber 312*c* is a long space extending in the direction along the b-axis over the plurality of nozzles N, and allows the space Ra and the plurality of supply flow paths 312*a* to be communicatively coupled to each other. Each of the plurality of communication flow paths 312*b* overlaps with one nozzle N corresponding to the communication flow path 312*b* in plan view.

The pressure chamber substrate 313 is a plate-shaped member in which a plurality of pressure chambers Cv called cavities are formed for each of the first nozzle array L1 and the second nozzle array L2. The plurality of pressure chambers Cv are arrayed in the direction along the b-axis. Each pressure chamber Cv is a long space formed for each nozzle N and extending in the direction along the a-axis in plan view. Each of the flow path substrate 312 and the pressure chamber substrate 313 is manufactured by processing a silicon single crystal substrate by, for example, a semiconductor manufacturing technology in the same manner as the nozzle plate 314 described above. However, other known methods and materials may be appropriately used for manufacturing the flow path substrate 312 and the pressure chamber substrate 313.

The pressure chamber Cv is a space positioned between the flow path substrate 312 and the vibration plate 316. The plurality of pressure chambers Cv are arrayed in the direction along the b-axis for each of the first nozzle array L1 and the second nozzle array L2. The pressure chamber Cv is communicatively coupled to each of the communication flow paths 312*b* and the supply flow paths 312*a*. Accordingly, the pressure chamber Cv is communicatively coupled to the nozzle N via the communication flow path 312*b* and is communicatively coupled to the space Ra via the supply flow path 312*a* and the supply liquid chamber 312*c*.

The vibration plate 316 is disposed on a surface of the pressure chamber substrate 313 facing the c2 direction. The vibration plate 316 is a plate-shaped member that can vibrate elastically. The vibration plate 316 has, for example, an elastic film made of silicon oxide (SiO2) and an insulating film made of zirconium oxide (ZrO2), and these films are stacked. The elastic film is formed, for example, by thermally oxidizing one surface of a silicon single crystal substrate. The insulating film is formed by, for example, forming a zirconium layer by a sputtering method and thermally oxidizing the layer.

The plurality of piezoelectric elements 311 respectively corresponding to each nozzle N are arranged on a surface of the vibration plate 316 facing the c1 direction for each of the first nozzle array L1 and the second nozzle array L2. Each piezoelectric element 311 is a passive element deformed by the supply of the above-described drive pulse PD. Each piezoelectric element 311 has a long shape extending in the direction along the a-axis in plan view. The plurality of piezoelectric elements 311 are arrayed in the direction along the b-axis so as to correspond to the plurality of pressure chambers Cv. When the vibration plate 316 vibrates in conjunction with the deformation of the piezoelectric element 311, the pressure in the pressure chamber Cv fluctuates, and thus, the ink is discharged from the nozzle N in the c2 direction.

The housing 318 is a case for reserving the ink to be supplied to the plurality of pressure chambers Cv. As illustrated in FIG. 4, a space Rb is formed in the housing 318 of the present embodiment for each of the first nozzle array L1 and the second nozzle array L2. The space Rb of the housing 318 and the space Ra of the flow path substrate 312 are communicatively coupled to each other. A space formed of the space Ra and the space Rb functions as a liquid storage chamber R which is a reservoir for reserving the ink supplied to the plurality of pressure chambers Cv. The Ink is supplied to the liquid storage chamber R via an introduction port 318*a* formed in the housing 318. The ink in the liquid storage chamber R is supplied to the pressure chamber Cv via the supply liquid chamber 312*c* and each supply flow path 312*a*. The vibration absorber 315 is a flexible film-like compliance substrate constituting the wall surface of the liquid storage chamber R, and absorbs a pressure fluctuation in the ink in the liquid storage chamber R.

The wiring substrate 317 is a plate-shaped member in which wirings for electrically coupling the drive circuit 340 and the plurality of piezoelectric elements 311 are formed. A surface of the wiring substrate 317 facing the c2 direction is joined to the vibration plate 316 via a plurality of conductive bumps T. On the other hand, the drive circuit 340 is mounted on a surface of the wiring substrate 317 facing the c1 direction.

The drive circuit 340 is an integrated circuit (IC) chip that outputs a drive signal and a reference voltage for driving each piezoelectric element 311. Specifically, the drive circuit 340 switches whether or not to supply, as the drive pulse PD, the drive signal Com for each of the plurality of piezoelectric elements 311 based on the above-mentioned control signal SI.

Although not illustrated, an end portion of an external wiring electrically coupled to the control device 600 is joined to the surface of the wiring substrate 317 facing the c1 direction. The external wiring includes, for example, coupling components such as flexible printed circuits (FPC)

or flexible flat cable (FFC). The wiring substrate 317 may be the FPC, the FFC, or the like.

Figure 5:
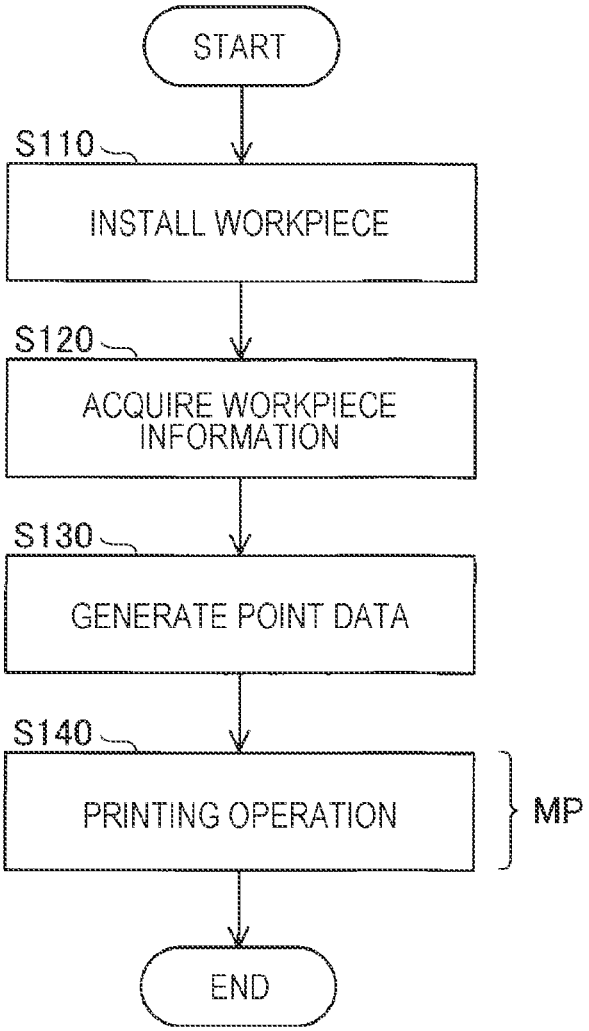
FIG. 5 is a flowchart illustrating a flow of a three-dimensional object printing method according to the first embodiment.

1-4. Operation of Three-Dimensional Object Printing Apparatus and Three-Dimensional Object Printing Method FIG. 5 is a flowchart illustrating the flow of a three-dimensional object printing method according to the first embodiment. The three-dimensional object printing method is performed by using the three-dimensional object printing apparatus 100. In the three-dimensional object printing apparatus 100, as illustrated in FIG. 5, the workpiece W is first installed in step S110. The workpiece may be installed manually by the user, or may be automatically installed by the operation of the robot 200 according to the program PG1.

Next, in step S120, the workpiece information Da is generated by the data generation section 614 using the CAD data of the workpiece W as described above. Then, in step S130, the point data Dc is generated by the data generation section 614. In the present embodiment, the point data Dc generated in step S130 indicates an ideal scanning path as the reference path. Then, in step S140, the printing operation MP is performed N times according to the number of passes by using the point data Dc generated in step S130. In the printing operation MP of the present embodiment, the relative positional relationship of the liquid discharge head 310 with respect to the workpiece W is detected by using the sensor 330. In each printing operation MP of the present embodiment, the position of the liquid discharge head 310 is controlled by using not only the point data Dc but also the detection data Db from the sensor 330.

Figure 6:
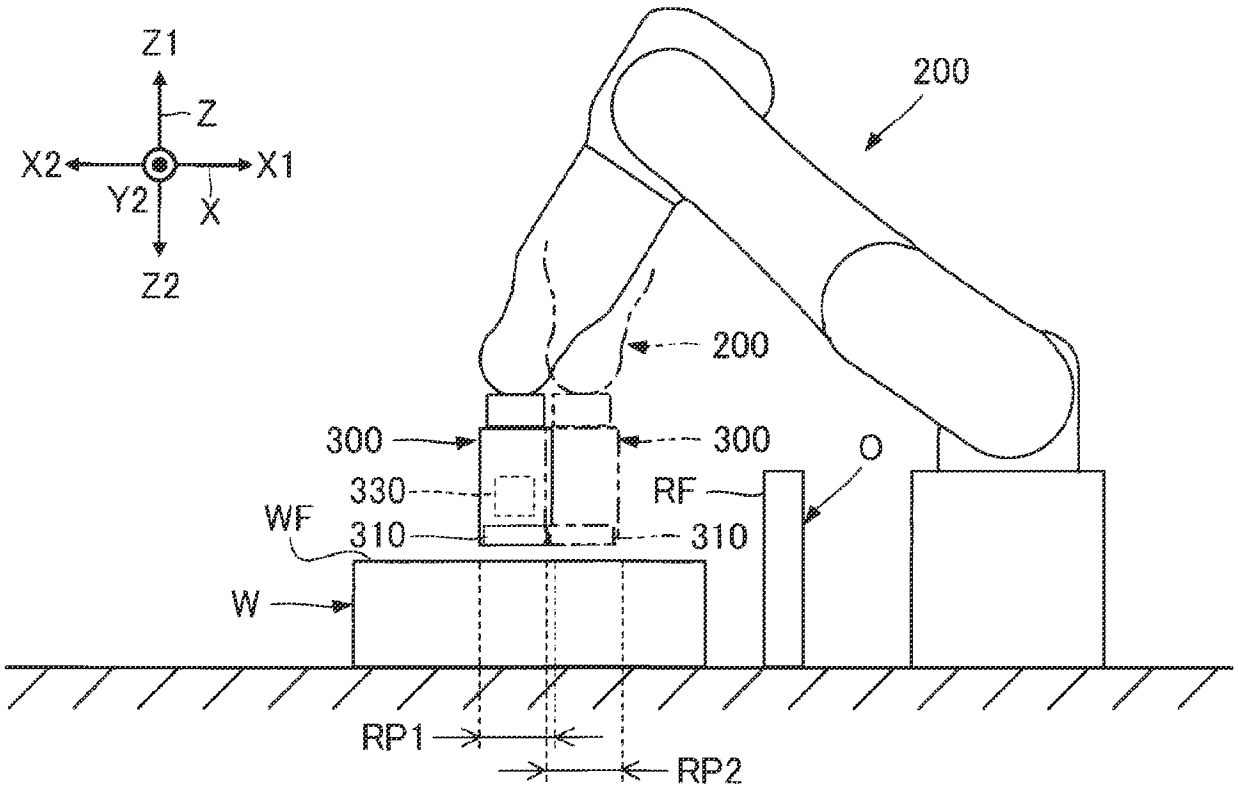
FIG. 6 is a diagram illustrating a first printing operation and a second printing operation in the first embodiment.

FIG. 6 is a diagram illustrating the first printing operation MP_1 and the second printing operation MP_2 in the first embodiment. FIG. 6 illustrates a case where the number of passes, which is the number of times of printing operation MPs, is two. In the example illustrated in FIG. 6, in each operation, the liquid discharge head 310 is scanned in the direction along the Y-axis. Here, the scanning direction of the liquid discharge head 310 is along the a-axis in the tool coordinate system described above.

Printing by the first printing operation MP_1, which is the printing operation MP of the first pass, is performed on a first region RP1 of the workpiece W. Similarly, printing by the second printing operation MP_2, which is the printing operation MP of the second pass, is performed on a second region RP2 of the workpiece W. Here, the first region RP1 and the second region RP2 are disposed so as to deviate in the direction along the X-axis so that parts of the first region RP1 and the second region RP2 overlap each other. Typically, each of the first region RP1 and the second region RP2 is a strip-shaped region extending in the scanning direction of the liquid discharge head 310. In the example illustrated in FIG. 6, the number of passes is two, but the number of passes is not limited thereto, and may be one or three or more.

Figure 7:
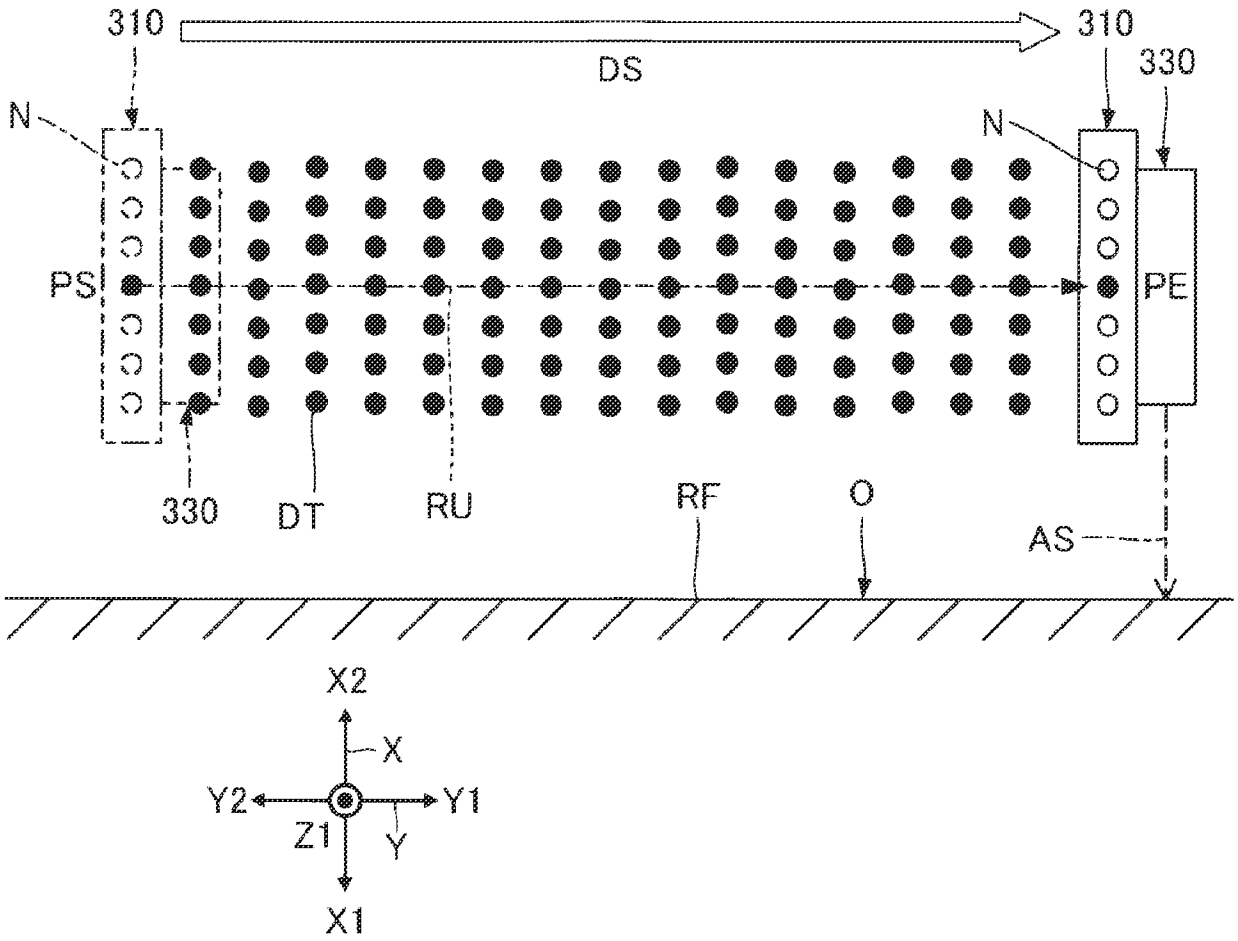
FIG. 7 is a diagram illustrating each printing operation in the first embodiment.

FIG. 7 is a diagram illustrating each printing operation MP in the first embodiment. FIG. 7 schematically illustrates the plurality of nozzles N of the liquid discharge head 310. In FIG. 7, a set of the reference path RU, which is an ideal scanning path, and a printed image that is a set of a plurality of dots DT formed on the workpiece W by scanning the ideal scanning path and discharging the liquid from the liquid discharge head 310 are schematically illustrated. In the example illustrated in FIG. 7, the ideal scanning path is a linear path along the scanning direction DS of the liquid discharge head 310, but may have a curved or bent portion depending on the shape of the workpiece W or the like, and a printed image is also formed by being curved or bent on the workpiece W accordingly.

In the example illustrated in FIG. 7, the point data Dc is composed of a plurality of pieces of data including data PS and PE. The data PS indicates the start position of the liquid discharge head 310 in the scanning path. The data PE indicates the end position of the liquid discharge head 310 in the scanning path. Although not illustrated, the point data Dc includes a plurality of pieces of data indicating a position between a start position and an end position in the scanning path of the liquid discharge head 310, in addition to the data PS and PE. The number of pieces of data indicating the position between the start position and the end position in the scanning path of the liquid discharge head 310 is any number. In the example illustrated in FIG. 7, the pose of the liquid discharge head 310 is ideally disposed and moved by the robot 200 so that the X-axis and the b-axis are parallel, the Y-axis and the a-axis are parallel, and the Z-axis and the c-axis are parallel, but such a correspondence between the tool coordinate system and the base coordinate system is deviated due to an error described later.

As illustrated in FIG. 7, in the printing operation MP of the present embodiment, the liquid discharge head 310 moves along the Y-axis. At this time, the position of the liquid discharge head 310 is controlled based on the detection result of the sensor 330 so that the actual scanning path approaches the reference path RU, which is the ideal scanning path. In the printing operation MP of the present embodiment, the positions of the liquid discharge head 310 with respect to the X coordinate, the Y coordinate, and the Z coordinate are controlled by using the point data Dc. Here, with respect to the X coordinate, the position is controlled by using the detection data Db in addition to the point data Dc.

In the example illustrated in FIG. 7, the reference plane RF is a plane facing the X2 direction. Here, the detection axis AS of the sensor 330 faces the X1 direction and intersects the reference plane RF. The output of the sensor 330 changes according to the positional relationship of the liquid discharge head 310 with respect to the workpiece W in the direction along the X-axis. Therefore, when the reference plane RF is parallel to the scanning direction DS of the liquid discharge head 310 as in the present embodiment, by controlling the drive of the robot 200 so that the output of the sensor 330 is constant, the deviation of the actual scanning path of the liquid discharge head 310 from the reference path RU in the direction along the X-axis is reduced.

As described above, the three-dimensional object printing apparatus 100 includes the liquid discharge head 310, the robot 200 which is an example of a "moving mechanism", and the sensor 330. Here, the liquid discharge head 310 is a nozzle surface F provided with a first nozzle array L1 or a second nozzle array L2 which is an example of a "nozzle array" including a plurality of nozzles N for discharging ink which is an example of "liquid". The robot 200 changes the position of the liquid discharge head 310 relative to the three-dimensional workpiece W. The sensor 330 detects the positional relationship of the liquid discharge head 310 with respect to the workpiece W.

As described above, the c-axis, which is an example of a "first axis", is an axis parallel to the normal line of the nozzle surface F or an axis parallel to the ink discharge direction from the liquid discharge head 310. The a-axis, which is an example of a "second axis", is an axis parallel to the nozzle surface F and intersecting the extending direction of the first nozzle array L1 or the second nozzle array L2, or an axis parallel to the scanning direction of the liquid discharge head 310 with respect to the workpiece W by the robot 200. The b-axis, which is an example of a "third axis", is an axis that intersects both the c-axis and the a-axis, and is preferably an axis that extends in a direction along the first nozzle array L1 or the second nozzle array L2.

In this way, when the c-axis is set as the "first axis", the a-axis is set as the "second axis", and the b-axis is set as the "third axis", the sensor 330 detects the relative positional relationship of the liquid discharge head 310 with respect to the workpiece W in the direction along the b-axis. Therefore, when the liquid discharge head 310 is moved with respect to the workpiece W in the direction along the a-axis by controlling the drive of the robot 200 using this detection result, it is possible to reduce meandering in the direction along the b-axis of the scanning path of the liquid discharge head 310 with respect to the reference path RU. That is, by controlling the drive of the robot 200 using the detection result of the sensor 330, the fluctuation of the position of the liquid discharge head 310 with respect to the workpiece W in the direction along the b-axis is reduced.

Here, the fluctuation of the position of the liquid discharge head 310 with respect to the workpiece W in the direction along the b-axis has a greater influence on the quality of the printed image than the fluctuation of the position of the liquid discharge head 310 with respect to the workpiece W in the direction along the a-axis and the c-axis.

A case where a printed image formed on the workpiece is formed by one time of printing operation will be described with an example illustrated in FIG. 7. The printed image has an end portion in the X-axis direction corresponding to the liquid discharge head 310*b*-axis direction, and this end portion is the boundary in the X-axis direction between the region where an image is formed and the region where an image is not formed on the workpiece. The fluctuation of the position in the b-axis direction due to the drive of the robot 200 becomes conspicuous as the meandering of the boundary in the X-axis direction, and has a great influence on the quality of the printed image.

On the other hand, the printed image also has an end portion in the Y-axis direction corresponding to the a-axis, which is a boundary in the Y-axis direction between the region where an image is formed and the region where an image is not formed on the workpiece, but the positions of the nozzles N are fixed in advance in the a-axis direction corresponding to the Y-axis direction, and therefore meandering of the boundary in the Y-axis direction does not occur in one time of printing operation. Even when one printed image is formed by a plurality of times of printing operations, the boundary in the Y-axis direction does not deviate except for the joint portions of the image due to the individual printing operations. Therefore, the fluctuation of the position in the a-axis direction due to the drive of the robot 200 has a smaller influence on the quality of the printed image than the fluctuation of the position in the b-axis direction.

The liquid discharge head 310 discharges droplets along the c-axis, and an urging force acts on the discharged droplets in the direction along the c-axis, and therefore the fluctuation of the position in the c-axis direction has smaller influence on the quality of the printed image than the fluctuation of the position in the b-axis direction.

From the above, reducing the fluctuation of the position of the liquid discharge head 310 with respect to the workpiece W in the direction along the b-axis is useful for improving the quality of the printed image in the three-dimensional object printing apparatus 100. In a normal printer that prints on paper by a method in which a carriage to which a liquid discharge head is mounted reciprocates along a rail, that is, a so-called multipath method, since the fluctuation of the position in the direction intersecting the scanning direction and the ink discharge direction, that is, the direction corresponding to the b-axis direction described above is regulated by the rail, the fluctuation of the position in this direction is less likely to be a problem.

In the present embodiment, as described above, the sensor 330 is a distance sensor. The position of the sensor 330 relative to the liquid discharge head 310 is fixed. The sensor 330 measures the distance from the reference plane RF of which a position relative to the workpiece W is fixed. Therefore, the sensor 330 can detect the relative positional relationship of the liquid discharge head 310 with respect to the workpiece W in the direction along the b-axis.

Even if the position of the sensor 330 relative to the workpiece W is fixed, the sensor 330 can detect the relative positional relationship of the liquid discharge head 310 with respect to the workpiece W in the direction along the b-axis. However, in the configuration in which the position of the sensor 330 relative to the workpiece W is fixed, the detection range of the sensor 330 is wide enough to include the moving range of the liquid discharge head 310, and therefore it is necessary to provide a large number of sensors 330. On the other hand, in the configuration in which the position of the sensor 330 relative to the liquid discharge head 310 is fixed, the number of sensors 330 may be one, and therefore there is an advantage that the configuration of the three-dimensional object printing apparatus 100 can be simplified.

As described above, the reference plane RF has a portion extending parallel to the a-axis, which is an axis parallel to the scanning direction of the liquid discharge head 310. Therefore, by controlling the drive of the robot 200 so that the detection result of the sensor 330 is constant, meandering in the direction along the b-axis of the liquid discharge head 310 can be reduced. On the other hand, when the reference plane RF is not parallel to the a-axis, it is necessary to grasp the state such as the shape or inclination of the reference plane RF in advance, take that state into consideration, and control the drive of the robot 200 based on the detection result of the sensor 330. Therefore, when the reference plane RF is not parallel to the a-axis, the calculation for controlling the drive of the robot 200 becomes more complicated than when the reference plane RF is parallel to the a-axis.

As described above, in the three-dimensional object printing apparatus 100, while the robot 200 moves the liquid discharge head 310 relative to the first region RP1 of the workpiece W, the liquid discharge head 310 executes the first printing operation MP_1 of discharging ink. In the three-dimensional object printing apparatus 100, while the robot 200 moves the liquid discharge head 310 relative to the second region RP2 that partially overlaps the first region RP1 of the workpiece W, the liquid discharge head 310 executes the second printing operation MP_2 of discharging ink.

Here, the movement amount of the liquid discharge head 310 in the direction along each of the a-axis and the c-axis in the first printing operation MP_1 is larger than the movement amount of the liquid discharge head 310 in the direction along the b-axis in the first printing operation MP_1. The movement amount of the liquid discharge head 310 in the direction along the a-axis in the first printing operation MP_1 is larger than the movement amount of the liquid discharge head 310 in the direction along the c-axis in the first printing operation MP_1.

As described above, the robot 200 is an articulated robot to which the liquid discharge head unit 300, which is an example of an "end effector" including the liquid discharge head 310, is attached. The robot 200 moves the liquid discharge head unit 300 along a linear path such as a straight line or a curved line by combining the operations of a plurality of the joint portions 231 to 236. At this time, even if the reference path RU, which is an ideal scanning path, is simply given to the robot 200 as an instruction of the path along which the liquid discharge head 310 should move, since the operation error of each joint portion appears at various timings due to various errors such as a processing error or an assembly error of each arm, mechanical vibration of each arm, eccentricity of the motor or the speed reducer, roughness of disassembly of the rotary encoder, and the like, the actual path meanders and deviates from the ideal path. It is difficult to predict such a deviation in advance. Therefore, when such the robot 200 is used as a moving mechanism, controlling the drive of the robot 200 using not only the information on the reference path RU but also the detection result of the sensor 330 is particularly useful in moving the liquid discharge head 310 along the ideal scanning path. The above-mentioned deviation of the actual path with respect to the ideal scanning path can also occur in a moving mechanism other than the articulated robot, that is, a mechanism capable of moving by combining the operations of a plurality of movable portions, and controlling the moving mechanism using the detection result of the sensor 330 is equally useful in moving the liquid discharge head 310 along the ideal scanning path.

The three-dimensional object printing apparatus 100 of the present embodiment performs detection by the sensor 330 during execution of the first printing operation MP_1. Therefore, by feedback control based on the detection result of the sensor 330, printing can be performed by the first printing operation MP_1 while controlling the position of the liquid discharge head 310.

Here, as described above, the control device 600, which is an example of the "controller" that controls the drive of the robot 200, is further provided. In the present embodiment, the sensor 330 outputs the detection data Db regarding the relative positional relationship of the liquid discharge head 310 with respect to the workpiece W to the control device 600 during the execution of the first printing operation MP_1. The control device 600 controls the drive of the robot 200 in the first printing operation MP_1 based on the detection data Db. More specifically, the control device 600 adjusts the position of the liquid discharge head relative to the workpiece W in the direction along the b-axis in the first printing operation MP_1 based on the detection data Db. Therefore, in the first printing operation MP_1, the position of the liquid discharge head 310 in the direction along the b-axis is controlled by the feedback control based on the detection result from the sensor 330.

2. Second Embodiment

Figure 8:
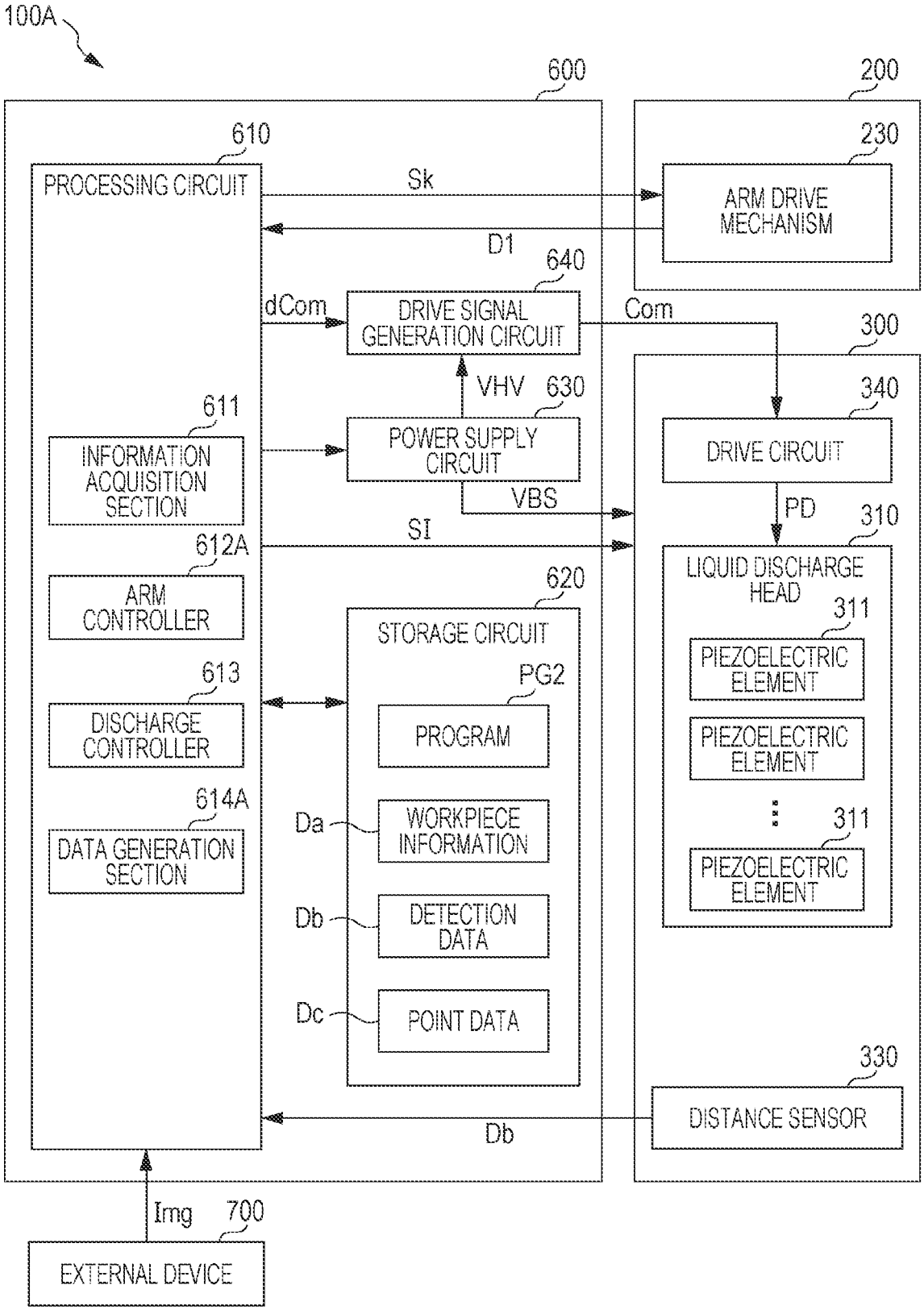
FIG. 8 is a block diagram illustrating an electrical configuration of the three-dimensional object printing apparatus according to a second embodiment.

FIG. 8 is a block diagram illustrating an electrical configuration of a three-dimensional object printing apparatus 100A according to a second embodiment. The three-dimensional object printing apparatus 100A is the same as the three-dimensional object printing apparatus 100 of the first embodiment described above, except that a program PG2 is used instead of the program PG1.

In the three-dimensional object printing apparatus 100A, the processing circuit 610 functions as an information acquisition section 611, an arm controller 612A, a discharge controller 613, and a data generation section 614A by executing the program PG2 stored in the storage circuit 620.

The arm controller 612A executes a detection operation MD described later of detecting the actual scanning path of the liquid discharge head 310 prior to the printing operation MP of printing an image based on the print data Img. As will be described in detail later, in the detection operation MD, the sensor 330 detects the relative positional relationship of the liquid discharge head 310 with respect to the workpiece W without discharging ink from the liquid discharge head 310.

Here, the detection operation MD performs detection by the sensor 330 while driving the robot 200 by using the point data Dc indicating the ideal scanning path. In addition to the function of generating the point data Dc indicating the ideal scanning path described above, the data generation section 614A has a function of correcting the point data Dc based on the detection data Db output from the sensor 330 in the detection operation MD. The printing operation MP of the present embodiment controls the position of the liquid discharge head 310 by using the corrected point data Dc.

The detection operation MD is performed N times corresponding to the number of times of the printing operation MP. In the following, the detection operation MD of the Nth pass is referred to "printing operation MD_N". Here, the detection operation MD of a first pass is a first detection operation MD_1. The detection operation MD of a second pass is a second detection operation MD_2. In the following, the point data Dc used in the Nth pass may be referred to as point data Dc_N.

Figure 9:
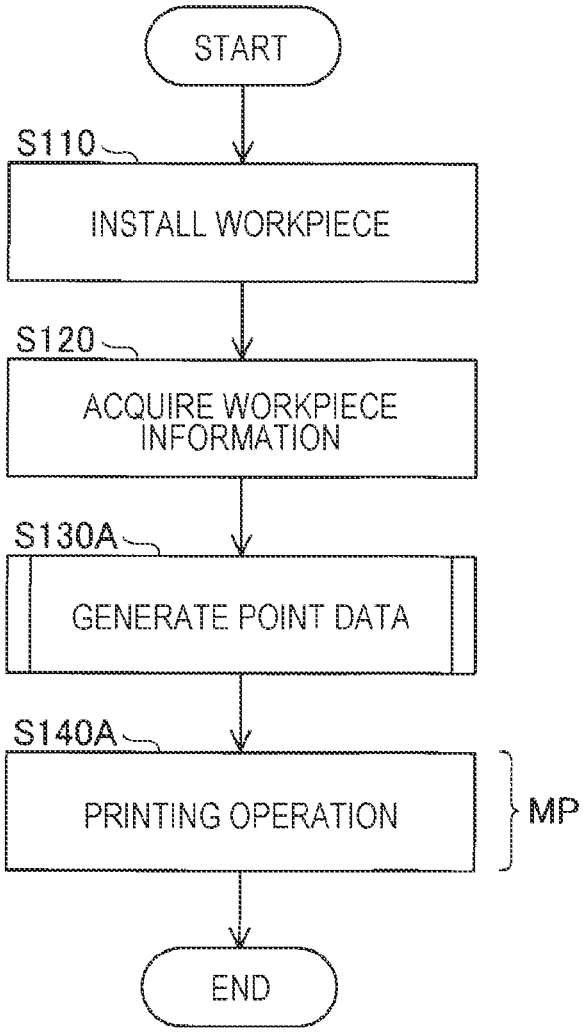
FIG. 9 is a flowchart illustrating a flow of a three-dimensional object printing method according to the second embodiment.

FIG. 9 is a flowchart illustrating the flow of the three-dimensional object printing method according to the second embodiment. The three-dimensional object printing method is performed by using the three-dimensional object printing apparatus 100A. In the three-dimensional object printing apparatus 100A, first, as in the first embodiment described above, steps S110 and S120 are executed, as illustrated in FIG. 9.

Then, in step S130A, the point data Dc is generated by the data generation section 614A. At this time, the detection operation MD is performed N times according to the number of passes. Then, in step S140A, the printing operation MP is performed N times according to the number of passes by using the corrected point data Dc generated in step S130A. Here, in the printing operation MP of the present embodiment, the positions of the liquid discharge head 310 with respect to the X coordinate, the Y coordinate, and the Z coordinate are controlled by using the corrected point data Dc.

Figure 10:
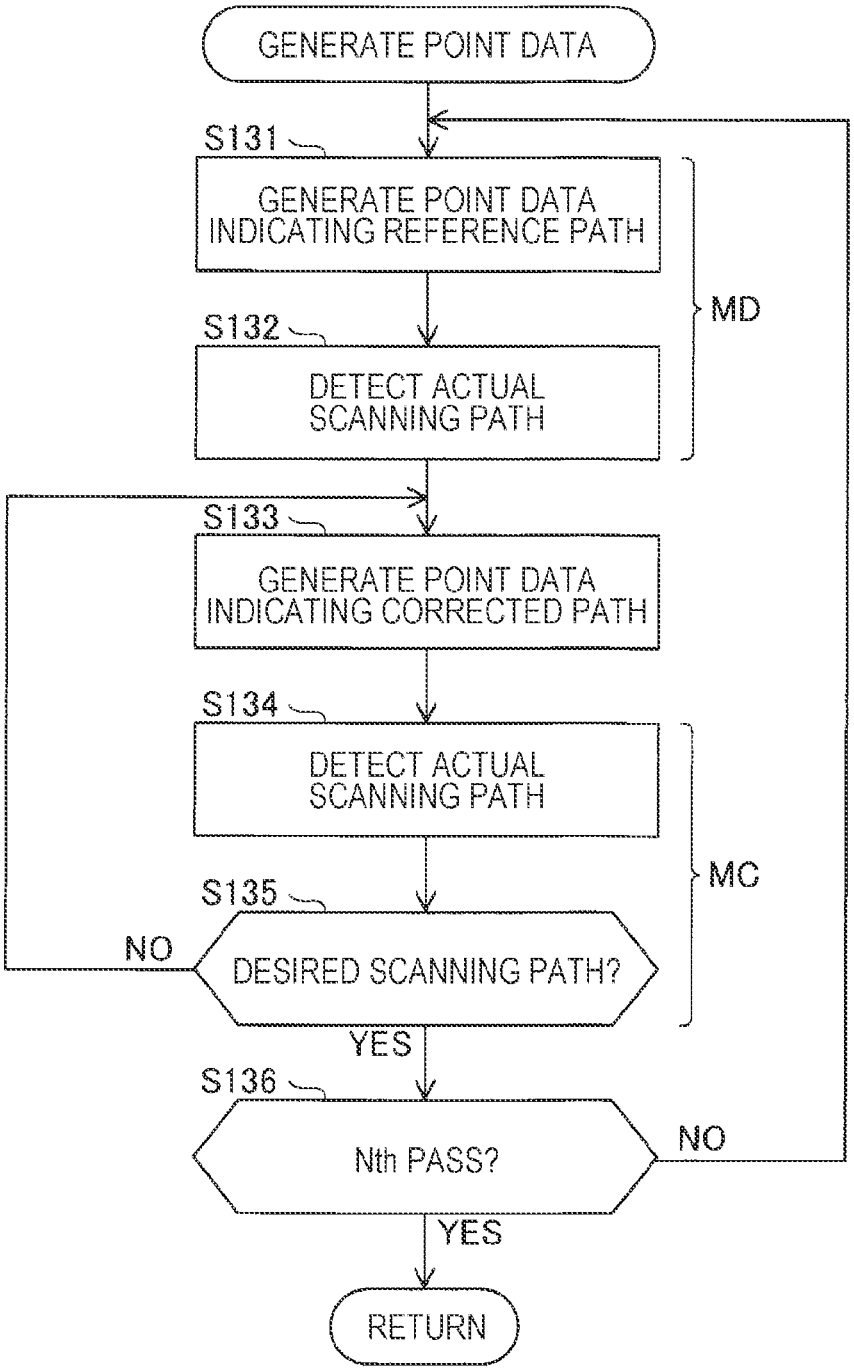
FIG. 10 is a flowchart illustrating a flow of generating point data illustrated in FIG. 9.

FIG. 10 is a flowchart illustrating the flow of generation of the point data Dc illustrated in FIG. 9. Hereinafter, the flow of processing in step S130A illustrated in FIG. 9 will be described based on FIG. 10. As illustrated in FIG. 10, first, the detection operation MD for detecting the actual scanning path of the liquid discharge head 310 is performed.

In the detection operation MD, first, in step S131, the data generation section 614A generates point data Dc indicating the ideal scanning path as a reference path based on the workpiece information Da. Next, in step S132, the actual scanning path is detected by using the sensor 330 while operating the robot 200 using the point data Dc generated in step S131.

Next, in step S133, the data generation section 614A generates the point data Dc indicating a corrected path based on the detection result of the detection operation MD, that is, the actual scanning path detected in step S132. Then, a confirmation operation MC is performed. The confirmation operation MC may be executed as necessary, and may be omitted as appropriate depending on the required degree of print quality and the like, and the time required for adjusting the point data Dc can be shortened. In other words, after the point data Dc is generated in step S133, the process may proceed directly to step S136.

In the confirmation operation MC, first, in step S134, the actual scanning path is detected by using the sensor 330 while operating the robot 200 using the point data Dc generated in step S133. Then, in step S135, it is determined whether or not the actual scanning path detected in step S134 is a desired scanning path. For example, when the difference between the actual scanning path detected in step S134 and the reference path is within a predetermined range, it is determined that the actual scanning path detected in step S134 is the desired scanning path.

If the actual scanning path is not the desired scanning path, the process returns to step S133 described above, and the point data Dc is adjusted so that the actual scanning path approaches the reference path. On the other hand, when the actual scanning path is the desired scanning path, in step S136, it is determined whether or not the pass is the Nth pass depending on whether or not the number of transitions from step S135 is the Nth.

When the Nth pass has not been reached, the process returns to step S131 described above, and the same processing as described above is performed for the subsequent pass. On the other hand, when the Nth pass is reached, the process proceeds to step S140A illustrated in FIG. 5 described above, and printing is performed.

Figure 11:
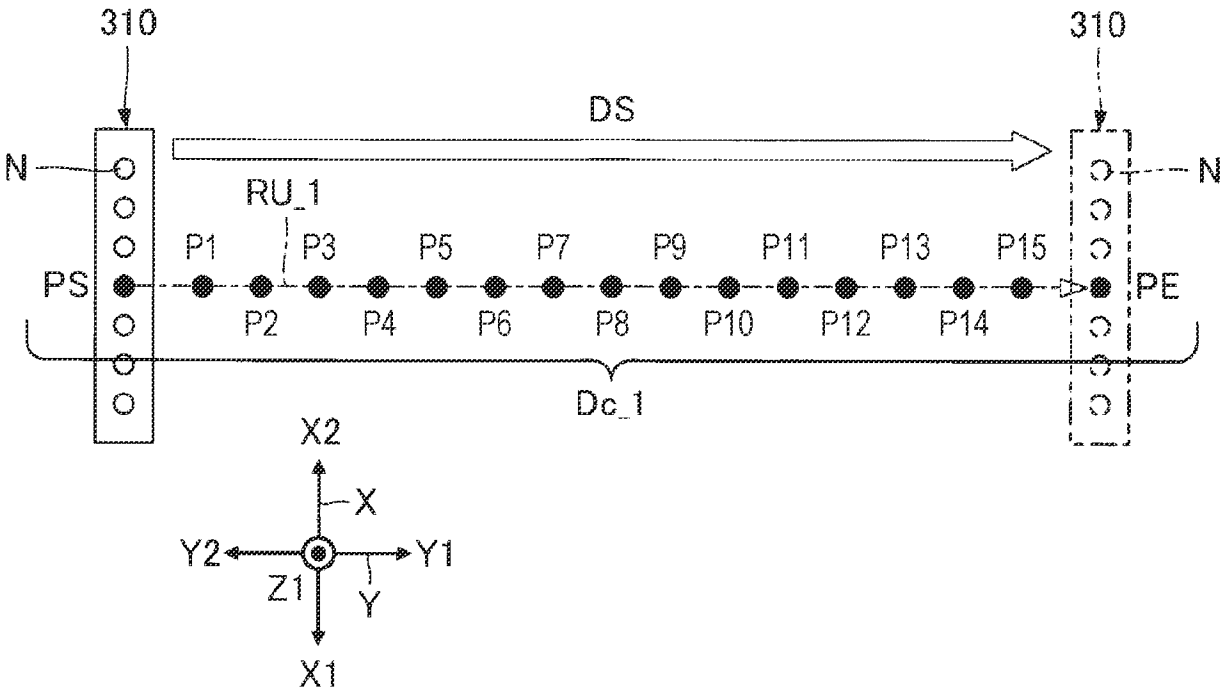
FIG. 11 is a diagram illustrating point data illustrating an ideal scanning path.

FIG. 11 is a diagram illustrating point data Dc illustrating the ideal scanning path. In FIG. 11, point data Dc_1 indicating the reference path RU_1, which is the ideal scanning path in the detection operation MD of the first pass, is illustrated. FIG. 11 schematically illustrates the plurality of nozzles N of the liquid discharge head 310. In FIG. 11, the ideal scanning path is a linear path along a scanning direction DS of the liquid discharge head 310, but the ideal scanning path may have curved or bent portions, if necessary.

In the example illustrated in FIG. 11, the point data Dc_1 is composed of 17 pieces of data including data PS, P1 to P15, and PE. The data P1 to P15 indicate positions between the start position and the end position of the liquid discharge head 310 in the scanning path. The number of pieces of data indicating the position between the start position and the end position of the liquid discharge head 310 in the scanning path is not limited to the example illustrated in FIG. 11, and is freely selected.

Figure 12:
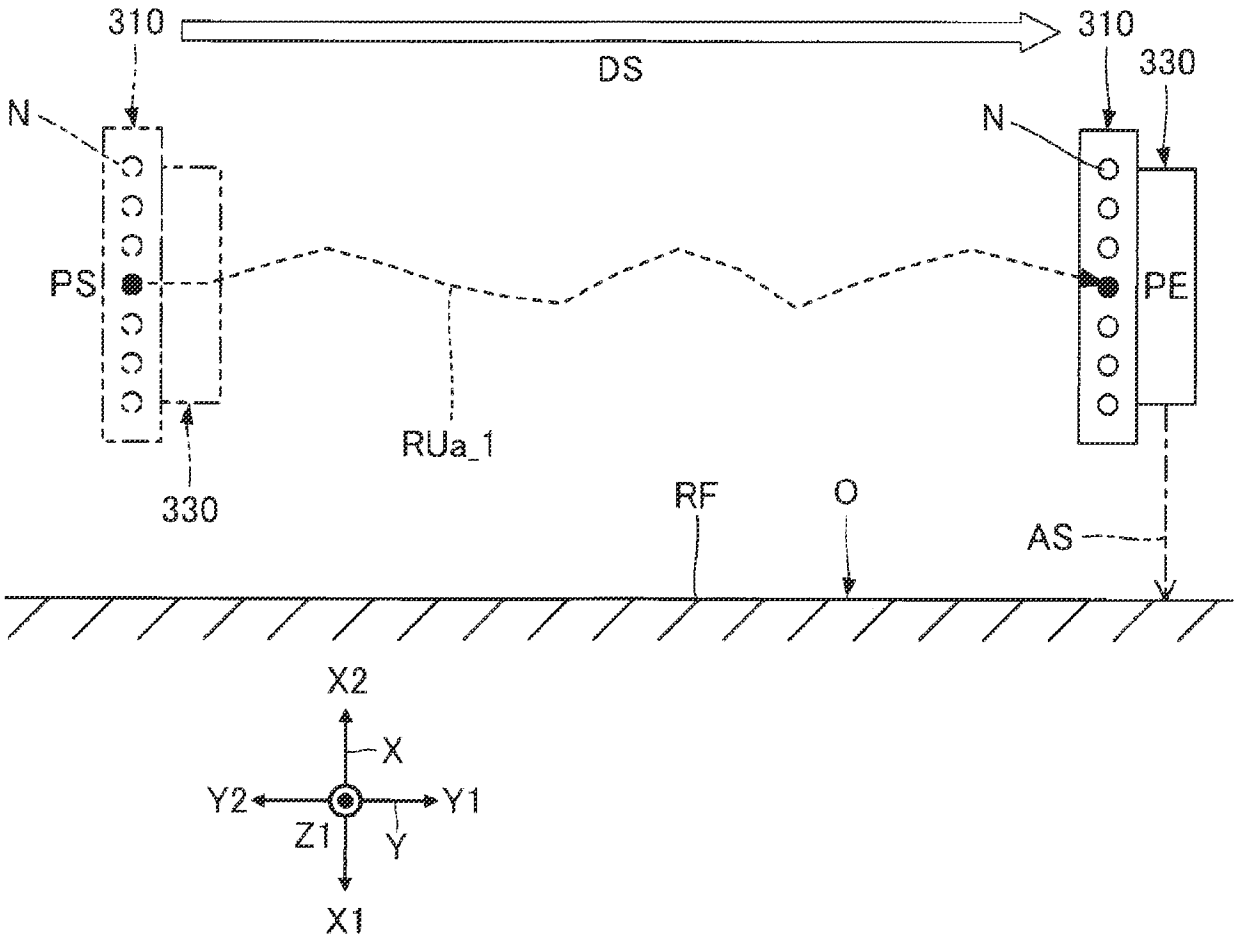
FIG. 12 is a diagram illustrating the detection of a position on an actual scanning path when the point data indicating the ideal scanning path is used.

FIG. 12 is a diagram illustrating the detection of the position of an actual scanning path RUa when the point data Dc indicating the ideal scanning path is used. In FIG. 12, a first scanning path RUa_1, which is the actual scanning path RUa in the detection operation MD of the first pass, is illustrated. In the detection operation MD of the first pass, as illustrated in FIG. 12, the position of the liquid discharge head 310 is controlled by using the point data Dc indicating the ideal scanning path. At this time, the ink is not discharged from the liquid discharge head 310, and the detection by the sensor 330 is performed in parallel.

In the example illustrated in FIG. 12, a state in which the first scanning path RUa_1 deviates and meanders from the ideal scanning path and meanders is illustrated. The detection of the first scanning path RUa_1 is performed by using the detection result of the sensor 330.

Figure 13:
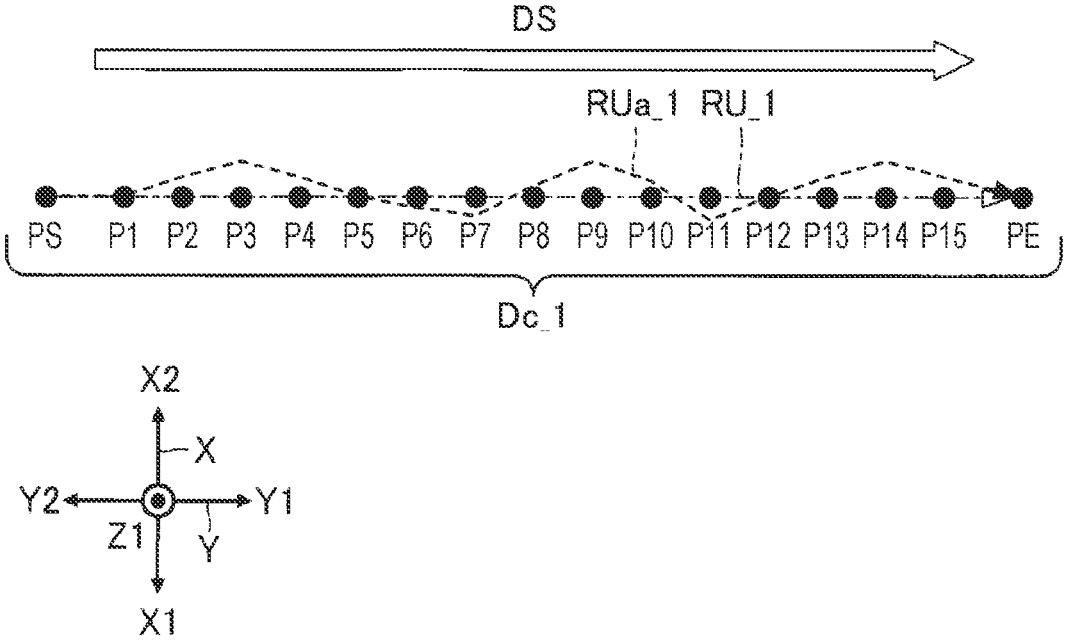
FIG. 13 is a diagram illustrating a deviation of the actual scanning path with respect to the ideal scanning path.

FIG. 13 is a diagram illustrating a deviation of the actual scanning path RUa with respect to the ideal scanning path. In FIG. 13, the first scanning path RUa_1, which is the actual scanning path in the detection operation MD of the first pass, is illustrated in comparison with the reference path RU_1.

Figure 14:
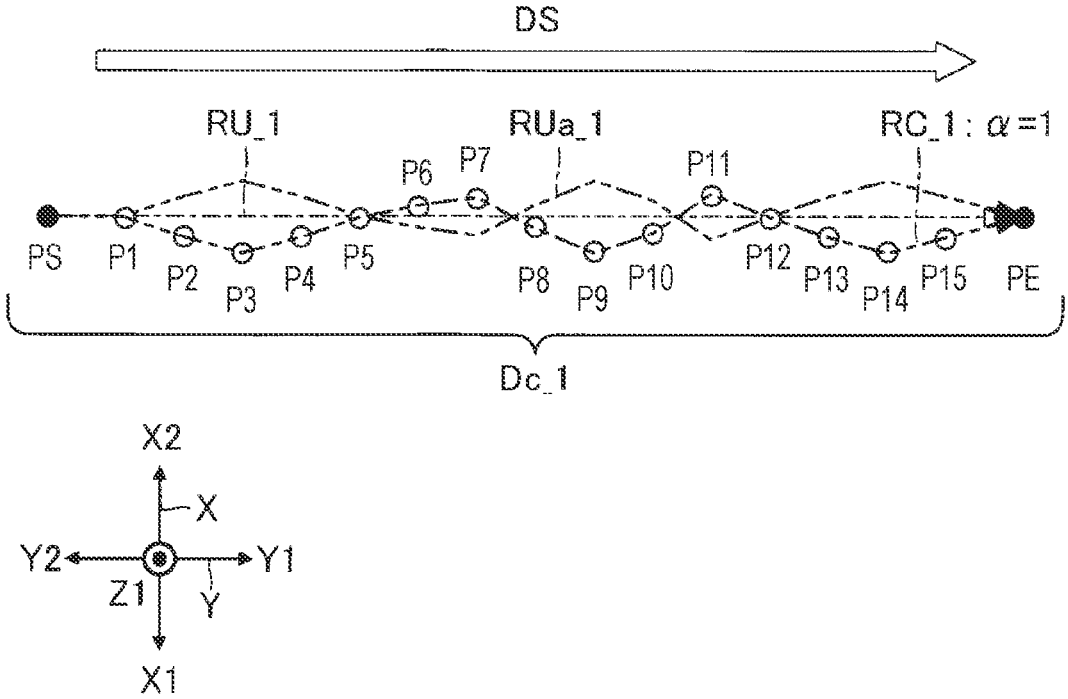
FIG. 14 is a diagram illustrating an example of point data corrected based on the actual scanning path.

FIG. 14 is a diagram illustrating an example of the point data Dc_1 corrected based on the actual scanning path RUa. In FIG. 14, the point data Dc_1 corrected by using the detection result of the detection operation MD of the first pass is illustrated. As illustrated in FIG. 14, the corrected point data Dc_1 generated in the above-mentioned step S133 is obtained by obtaining a corrected path RC_1 that moves so as to offset the deviation of the first scanning path RUa_1 with respect to the reference path RU_1 and correcting the point data Dc_1 so as to indicate the position of the corrected path RC_1.

In the example illustrated in FIG. 14, the absolute value of the difference between the reference path RU_1 and the corrected path RC_1 is equal to the absolute value of the difference between the reference path RU_1 and the first scanning path RUa_1. That is, when the absolute value of the difference between the reference path RU_1 and the corrected path RC_1 is the correction amount obtained by multiplying the absolute value of the difference between the reference path RU_1 and the first scanning path RUa_1 by a coefficient $\alpha$, $\alpha$ is 1.

Figure 15:
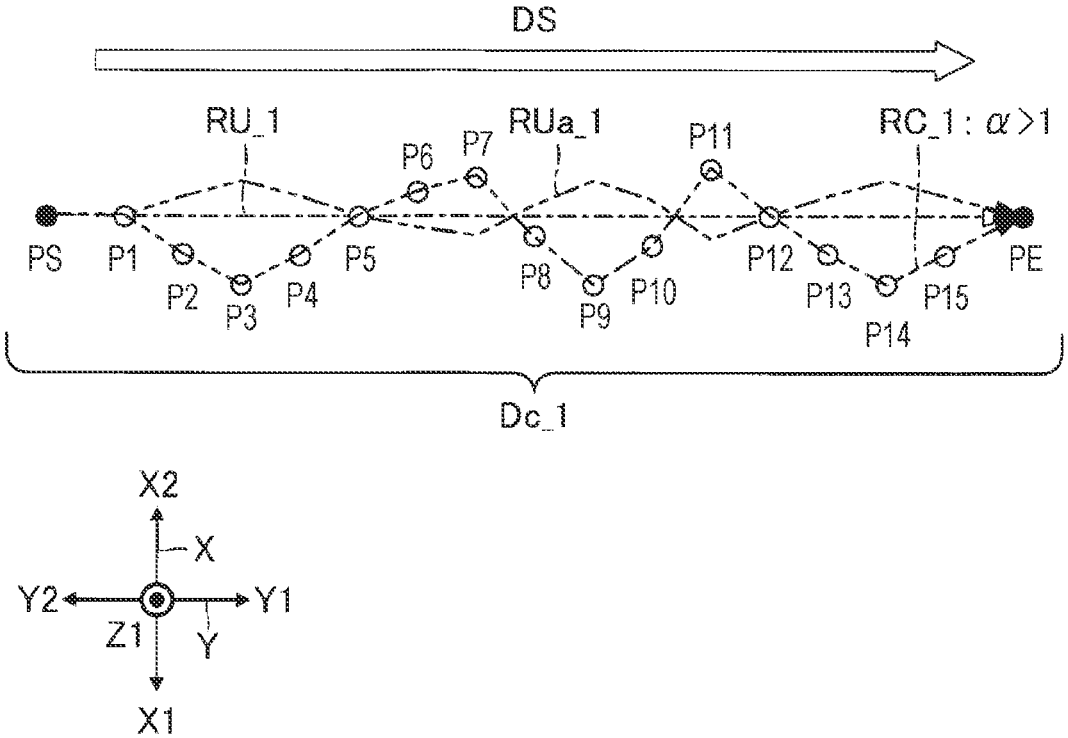
FIG. 15 is a diagram illustrating another example of point data corrected based on the actual scanning path.

FIG. 15 is a diagram illustrating another example of the point data Dc_1 corrected based on the actual scanning path RUa. In the example illustrated in FIG. 15, the absolute value of the difference between the reference path RU_1 and the corrected path RC_1 is larger than the absolute value of the difference between the reference path RU_1 and the first scanning path RUa_1. That is, when the absolute value of the difference between the reference path RU_1 and the corrected path RC_1 is the correction amount obtained by multiplying the absolute value of the difference between the reference path RU_1 and the first scanning path RUa_1 by the coefficient $\alpha$, $\alpha$ is larger than 1. That is, the degree of correction of the point data Dc_1 based on the actual scanning path RUa can be freely set by the coefficient $\alpha$. Although FIG. 15 illustrates a case where a is larger than 1, it is also possible to set a smaller than 1.

Figure 16:
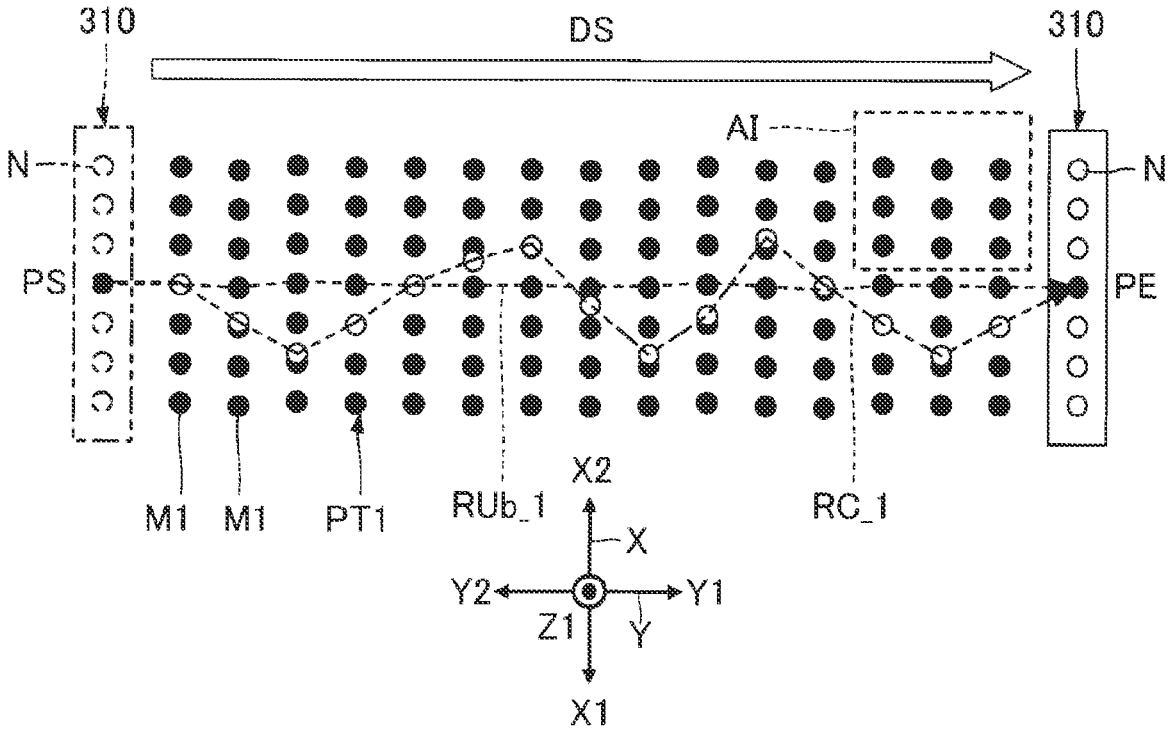
FIG. 16 is a diagram illustrating the actual scanning path when the corrected point data is used.

FIG. 16 is a diagram illustrating an actual scanning path RUb when the corrected point data Dc_1 is used. FIG. 16 illustrates a state in which printing is performed while the robot 200 is operated by using the point data Dc_1 corrected based on the detection result of the detection operation MD in the confirmation operation MC or the printing operation MP. In FIG. 16, the corrected path RC_1 illustrated in FIG. 15 described above is illustrated for comparison with an actual scanning path.

As illustrated in FIG. 16, the deviation of the second scanning path RUb_1 with respect to the ideal scanning path is reduced.

The second embodiment as described above can also improve the image quality of printing on the three-dimensional workpiece W, as in the first embodiment described above. As described above, the three-dimensional object printing apparatus 100A of the present embodiment executes the first printing operation MP_1 by using the detection data Db after executing the detection operation MD. Here, the detection data Db is information regarding the relative positional relationship of the liquid discharge head 310 with respect to the workpiece W by the sensor 330. The detection operation MD outputs the detection data Db while the robot 200 moves the liquid discharge head 310 with respect to the workpiece W.

In this way, the first printing operation MP_1 is executed by using the detection data Db obtained by executing the detection operation MD. Therefore, by feedforward control based on the detection result of the sensor 330, printing can be performed by the first printing operation MP_1 while controlling the position of the liquid discharge head 310. In the feedforward control, even if the scanning speed of the liquid discharge head 310 is increased, the meandering of the liquid discharge head 310 can be easily reduced as compared with the configuration using the feedback control as in the first embodiment described above. In other words, in the feedforward control, the scanning speed of the liquid discharge head 310 can be increased as compared with the configuration using the feedback control as in the first embodiment described above. The present embodiment has an advantage that the control of the position of the liquid discharge head 310 is less likely to be affected by the disturbance as compared with the first embodiment described above.

Here, as described above, the three-dimensional object printing apparatus 100A generates the point data Dc indicating a position where the liquid discharge head 310 should pass in the first printing operation MP_1 based on the detection data Db so as to be closer to the reference path than the scanning path of the liquid discharge head 310 with respect to the workpiece W in the detection operation MD. Therefore, in the first printing operation MP_1, the scanning path of the liquid discharge head 310 can be controlled to approach the reference path by using the generated point data Dc.

3. Modification Examples

The embodiments in the above examples can be variously modified. Specific modification aspects applicable to each of the above-mentioned embodiments are illustrated below. It should be noted that two or more aspects randomly selected from the following examples can be appropriately merged without contradicting each other.

3-1. Modification Example 1

Although the configuration using the 6-axis vertical articulated robot as the moving mechanism is illustrated in the above-described embodiments, the present disclosure is not limited to this configuration. The moving mechanism can change the position and pose of the liquid discharge head relative to the workpiece in three dimensions. Accordingly, the moving mechanism may be, for example, a vertical articulated robot other than the 6-axis robot, or may be a horizontal multi-axis robot. A movable portion of the robot arm is not limited to a rotating mechanism, and may be, for example, an expansion and contraction mechanism or the like.

3-2. Modification Example 2

In the above-described embodiments, a configuration using screwing or the like as a method for fixing the liquid discharge head to the tip of the robot arm is exemplified, but the configuration is not limited to this configuration. For example, the liquid discharge head may be fixed to the tip of the robot arm by gripping the liquid discharge head by a gripping mechanism such as a hand attached to the tip of the robot arm.

3-3. Modification Example 3

Although the moving mechanism having the configuration for moving the liquid discharge head is illustrated in the above-described embodiments, the present disclosure is not limited to this configuration. For example, the position of the liquid discharge head may be fixed, the workpieces may be moved by the moving mechanism, and a position and a pose of the workpiece relative to the liquid discharge head may be changed three-dimensionally. In this case, for example, the workpiece is gripped by a gripping mechanism such as a hand attached to the tip of the robot arm.

3-4. Modification Example 4

Although a configuration in which printing is performed by using one type of ink is illustrated in the above-described embodiments, the present disclosure is not limited to this configuration, and is applicable to a configuration in which printing is performed by using two or more types of ink.

3-5. Modification Example 5

The application of the three-dimensional object printing apparatus of the present disclosure is not limited to printing. For example, a three-dimensional object printing apparatus that discharges a solution of a coloring material is used as a manufacturing apparatus that forms a color filter of a liquid crystal display apparatus. A three-dimensional object printing apparatus that discharges a solution of a conductive material is used as a manufacturing apparatus for forming a wiring and an electrode on a wiring substrate. The three-dimensional object printing apparatus can also be used as a jet dispenser for applying a liquid such as an adhesive to a workpiece.

What is claimed is:

1. A three-dimensional object printing apparatus comprising:

a liquid discharge head having a nozzle surface provided with a nozzle array including a plurality of nozzles for discharging a liquid;

a moving mechanism that changes a position of the liquid discharge head with respect to a three-dimensional workpiece; and a sensor that detects a positional relationship of the liquid discharge head with respect to the workpiece, wherein when an axis parallel to a normal line of the nozzle surface is set as a first axis, an axis parallel to the nozzle surface and intersecting an extending direction of the nozzle array is set as a second axis, and an axis that intersects both the first axis and the second axis is set as a third axis, the sensor detects a relative positional relationship of the liquid discharge head with respect to the workpiece in a direction along the third axis, the sensor is a distance sensor, a position of the distance sensor relative to the liquid discharge head is fixed, and the distance sensor measures a distance to a reference plane of which a position relative to the workpiece is fixed.

2. The three-dimensional object printing apparatus according to claim 1, wherein the moving mechanism causes the liquid discharge head to scan the workpiece in a direction along the second axis.

3. The three-dimensional object printing apparatus according to claim 1, wherein the third axis is an axis extending in a direction along the nozzle array.

4. The three-dimensional object printing apparatus according to claim 1, wherein the reference plane has a portion extending parallel to the second axis.

5. The three-dimensional object printing apparatus according to claim 1, wherein the apparatus executes a first printing operation in which the liquid discharge head discharges the liquid, while the moving mechanism moves the liquid discharge head relative to a first region of the workpiece.

6. The three-dimensional object printing apparatus according to claim 5, wherein a movement amount of the liquid discharge head in a direction along each of the first axis and the second axis in the first printing operation is larger than a movement amount of the liquid discharge head in the direction along the third axis in the first printing operation.

7. The three-dimensional object printing apparatus according to claim 5, wherein a movement amount of the liquid discharge head in a direction along the second axis in the first printing operation is larger than a movement amount of the liquid discharge head in a direction along the first axis in the first printing operation.

8. The three-dimensional object printing apparatus according to claim 5, wherein the apparatus executes a second printing operation in which the liquid discharge head discharges the liquid, while the moving mechanism moves the liquid discharge head relative to a second region partially overlapping the first region of the workpiece.

9. The three-dimensional object printing apparatus according to claim 5, wherein the moving mechanism is an articulated robot to which an end effector including the liquid discharge head is attached.

10. The three-dimensional object printing apparatus according to claim 9, wherein detection by the sensor is performed during execution of the first printing operation.

11. The three-dimensional object printing apparatus according to claim 10, further comprising:

a controller that controls drive of the articulated robot, wherein the sensor outputs detection data regarding the relative positional relationship of the liquid discharge head with respect to the workpiece during the execution of the first printing operation, and the controller controls drive of the moving mechanism in the first printing operation based on the detection data.

12. The three-dimensional object printing apparatus according to claim 11, wherein the controller adjusts a position of the liquid discharge head relative to the workpiece in the direction along the third axis in the first printing operation based on the detection data.

13. The three-dimensional object printing apparatus according to claim 5, wherein after executing a detection operation in which the sensor outputs detection data regarding the relative positional relationship of the liquid discharge head with respect to the workpiece, while the moving mechanism moves the liquid discharge head with respect to the workpiece, the apparatus executes the first printing operation using the detection data.

14. The three-dimensional object printing apparatus according to claim 13, wherein point data indicating a position where the liquid discharge head should pass in the first printing operation is generated so as to be closer to a reference path than a scanning path of the liquid discharge head with respect to the workpiece in the detection operation based on the detection data.

15. A three-dimensional object printing apparatus comprising:

a liquid discharge head having a nozzle surface provided with a nozzle array including a plurality of nozzles for discharging a liquid;

a moving mechanism that changes a position of the liquid discharge head with respect to a three-dimensional workpiece; and a sensor that detects a positional relationship of the liquid discharge head with respect to the workpiece, wherein when an axis parallel to a liquid discharge direction from the liquid discharge head is set as a first axis, an axis parallel to a scanning direction of the liquid discharge head with respect to the workpiece by the moving mechanism is set as a second axis, and an axis that intersects both the first axis and the second axis is set as a third axis, the sensor detects a relative positional relationship of the liquid discharge head with respect to the workpiece in a direction along the third axis, the sensor is a distance sensor, a position of the distance sensor relative to the liquid discharge head is fixed, and the distance sensor measures a distance to a reference plane of which a position relative to the workpiece is fixed.

16. The three-dimensional object printing apparatus according to claim 15, wherein the second axis is parallel to the nozzle surface and orthogonal to an extending direction of the nozzle array.

17. A three-dimensional object printing apparatus comprising:

a liquid discharge head having a nozzle surface provided with a nozzle array including a plurality of nozzles for discharging a liquid;

a moving mechanism that changes a position of the liquid discharge head with respect to a three-dimensional workpiece; and a sensor that detects a positional relationship of the liquid discharge head with respect to the workpiece, wherein when an axis parallel to a normal line of the nozzle surface is set as a first axis, an axis parallel to the nozzle surface and intersecting an extending direction of the nozzle array is set as a second axis, and an axis that intersects both the first axis and the second axis is set as a third axis, the sensor detects a relative positional relationship of the liquid discharge head with respect to the workpiece in a direction along the third axis, the apparatus executes a first printing operation in which the liquid discharge head discharges the liquid, while the moving mechanism moves the liquid discharge head relative to a first region of the workpiece, and a movement amount of the liquid discharge head in a direction along each of the first axis and the second axis in the first printing operation is larger than a movement amount of the liquid discharge head in the direction along the third axis in the first printing operation.

* * * * *